US006447331B1

(12) United States Patent
Fukatsu et al.

(10) Patent No.: US 6,447,331 B1
(45) **Date of Patent: *Sep. 10, 2002**

(54) JOINT CONNECTOR AND METHOD OF PRODUCING JOINT CONNECTOR

(75) Inventors: Yukihiro Fukatsu; Izumi Suzuki, both of Yokkaichi; Masanari Kawata, Nishi-Ibaragi-gun, all of (JP)

(73) Assignee: Sumitomo Wiring Systems, Ltd., Mie (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/571,299

(22) Filed: May 15, 2000

(30) Foreign Application Priority Data

May 19, 1999 (JP) ..... 11-138423
May 19, 1999 (JP) ..... 11-138424
Jun. 1, 1999 (JP) ..... 11-154175

(51) Int. Cl.[7] ..... H01R 27/00; H01R 29/00
(52) U.S. Cl. ..... 439/516; 439/511
(58) Field of Search ..... 439/516, 43, 49, 439/507, 510, 511, 521; 138/89

(56) References Cited

U.S. PATENT DOCUMENTS 5,060,372 A * 10/1991 Capp et al. ..... 439/885
5,769,555 A 6/1998 Okada
5,864,947 A 2/1999 Yamamoto et al.
6,058,977 A * 5/2000 Hotta ..... 138/89
6,086,411 A * 7/2000 Shinozaki ..... 439/521

FOREIGN PATENT DOCUMENTS

EP 0 438 120 A1 1/1991
JP A-4-32175 4/1992
JP A-9-213436 8/1997

* cited by examiner

*Primary Examiner*—Gary F. Paumen
*Assistant Examiner*—Felix O Figueroa
(74) *Attorney, Agent, or Firm*—Oliff & Berridge, PLC

(57) ABSTRACT

A bus bar base member 55W is integrally joined to a holder body 51 by insert molding, thereby forming a bus bar structure 50, and the bus bar base member 55W is severed at a portion thereof into a plurality of bus bars. One side (surface) of an interconnecting portion 56 is exposed at those regions, corresponding respectively to punching holes 54, and those regions, each disposed between the adjacent punching holes 54, at an entire area thereof to provide an entire exposure surface 56A. When there is used a die 71 adapted to be held against this exposed surface, there is no need to form any convex portion of a low strength on the die 71.

9 Claims, 14 Drawing Sheets

JOINT CONNECTOR AND METHOD OF PRODUCING JOINT CONNECTOR

BACKGROUND OF THE INVENTION

This invention relates to a joint connector and a method of producing the joint connector.

There is known a joint connector of the type in which a bus bar structure is attached to a housing having a plurality of juxtaposed metal terminals received therein. The bus bar structure comprises a holder body, made of a synthetic resin, and a plurality of bus bars made of metal, and each of the bus bars has a plurality of tabs. The tabs are divided into a plurality of groups, and the group of tabs for each bus bar are electrically connected to each other. When the bus bar structure is attached to the housing, the tabs contact the associated metal terminals, respectively, so that the plurality of metal terminals are short-circuited in a predetermined pattern. One such joint connector is disclosed in the Unexamined Japanese Patent Application Publication No. Hei 4-32175.

Even in the case where there are a plurality of short-circuiting patterns, the bus bar structure includes the bus bar-forming part of a common design so that the number of the component parts can be reduced. More specifically, as shown in FIG. 9, a bus bar base member 102, having a plurality of juxtaposed tabs 104 extending from a side edge of a strip-like interconnecting portion 103, is integrally joined to a tubular holder body 101 by insert molding, thereby producing a bus bar structure 100 of a common design. Then, the interconnecting portion 103 of the bus bar structure 100 is severed at a portion thereof, thereby dividing the bus bar base member 102 into a plurality of bus bars corresponding to a predetermined short-circuiting pattern.

A plurality of upwardly and downwardly-open, punching grooves 105 are formed in the holder body 101, and that portion of the interconnecting portion 103, disposed between any two adjacent tabs 104, is exposed through the corresponding punching groove 105. For severing the connecting portion 103, a die 106 is held against the lower surface of the interconnecting portion 103 at the predetermined punching groove 105, and a punch 107 is driven from the upper side, as shown in FIG. 10.

The die 106 has a pair of guide walls 106A for fitting into the punching groove 105 from the lower side, and the punch 107 has a projecting piece-shape so as to be inserted between the two guide walls 106A. In the severing operation, the distal ends of the guide walls 106A are held against the lower surface of the interconnecting portion 103, and in this condition the punch 107 is driven to punch part (a portion) of the interconnecting portion, and this removed piece is received in the gap between the two guide walls 106A.

In the above joint connector, any two adjacent punching grooves 105 are separated from each other by a partition wall 108, and therefore the guide walls 106A must be formed on the die 106 so as to extend a long the opposed partition walls 108, respectively. The smaller the width of the punching grooves 105, the smaller the thickness of the guide walls 106A, and the smaller the pitch of the tabs 104 (that is, the pitch of the metal terminals), the smaller the width of the punching grooves 105. However, recently, it has been desired to achieve a compact design of the joint connector, that is, to reduce the pitch of the metal terminals, and in order to meet this requirement, the width of the punching grooves 105 must be reduced, and in this connection, the thickness of the guide walls 106A must also be reduced. However, this invites a problem that the strength of the guide walls 106A is reduced.

It is provided with a joint connector of the type in which a bus bar structure is attached to a housing having a plurality of juxtaposed metal terminals received therein. The bus bar structure comprises a holder body, made of a synthetic resin, and a plurality of bus bars made of metal, and each of the bus bars has a plurality of tabs. The tabs are divided into a plurality of groups, and the group of tabs for each bus bar are electrically connected to each other. When the bus bar structure is attached to the housing, the tabs contact the associated metal terminals, respectively, so that the plurality of metal terminals are short-circuited in a predetermined pattern.

Even in the case where there are a plurality of short-circuiting patterns, the bus bar structure includes the bus bar-forming part of a common design so that the number of the component parts can be reduced. More specifically, as shown in FIG. 16, a bus bar base member 202, having a plurality of juxtaposed tabs 202B extending from a side edge of a strip-like interconnecting portion 202A, is integrally joined to a tubular holder body 201 by insert molding, thereby producing a bus bar structure 200 of a common design. Then, the interconnecting portion 202A of the bus bar structure 200 is severed at a portion 202C thereof, thereby dividing the bus bar base member 202 into a plurality of bus bars 203 corresponding to a predetermined short-circuiting pattern.

A plurality of punching holes 204 are formed in the holder body 201, and each punching hole 204 is disposed in registry with that portion of the interconnecting portion 202A disposed between the adjacent tabs 202B. The interconnecting portion 202A can be severed at the punching hole 204, using a die and a punch (not shown). With respect to the severed portion of the interconnecting portion 202A, the bus bar 203 serves to short-circuit a plurality of metal terminals (not shown), and it is clear from this that the interconnecting portion 202A is not severed at that portion thereof disposed between each endmost tab 202B (disposed at each end of the bus bar base member) and the adjoining tab 202B. Therefore, the punching hole 204 is not formed at those regions corresponding respectively to the opposite end portions of the bus bar base member 202, and the opposite end portions of the interconnecting portion 202A are embedded in the resin-molded holder body 201.

The punching holes 204 are formed by removing part of a mold (which holds the bus bar base member 202) in the insert molding operation. Therefore, the formation of the punching holes 204 is significant since this facilitates the severing of the interconnecting portion 202A, and besides can provide the regions where the bus bar base member 202 is held during the inserting molding. Therefore, in the case of the above construction in which any punching hole 204 is not formed in the opposite end portions, the end portions of the interconnecting portion 202A are deformed by an injection pressure during the molding operation, which leads to a possibility that the alignment of the tabs 202B, disposed respectively at the opposite end portions, are adversely affected.

A joint connector comprises a housing, having a plurality of juxtaposed metal terminals received therein, and a bus bar structure, which includes an electrically-conductive bus bar, having a plurality of juxtaposed tabs extending from a side edge of an interconnecting portion, and a holder body of a synthetic resin integrally joined to the busbar. When the busbar structure is attached to the housing, the tabs contact the associated metal terminals, respectively, so that the metal terminals are short-circuited in a predetermined pattern.

There is known a method of producing a bus bar structure for this kind of joint connector, in which a chain terminal structure, having a plurality of bus bars connected to side edges of a carrier through bridge portions, is first formed by pressing, and then the bus bar is integrally joined to a holder body by insert molding, and the bridge portions are severed, thereby separating the bus bar structure from the carrier. Such a production method is disclosed in the Unexamined Japanese Patent Application Publication No. Hei 9-213436.

In the production method disclosed in the above publication, the bus bars of the chain terminal structure are connected to the carrier in such a manner that projected ends of tabs are continuous with the bridge portions. Therefore, when the bridge portions are severed or cut off, cutting marks are formed on the tabs, which leads to a possibility that the distal end of the tab, pressed into a tapering shape, is deformed, and in the case where a flash is kept formed on the tab, there is a possibility that a metal terminal is caught by the flash when connecting the metal terminal to the tab.

SUMMARY OF THE INVENTION

This invention has been made under the above circumstances, and an object of the invention is to provide a construction in which any portion of a low strength does not need to be formed on a die.

According to the present invention, there is provided a joint connector comprising a housing having a plurality of juxtaposed metal terminals received therein; and a bus bar structure having a plurality of bus bars each having a plurality of tabs; wherein when the bus bar structure is attached to the housing, the tabs contact the associated metal terminals, respectively, so that the metal terminals are short-circuited in a predetermined pattern; and wherein a bus bar base member, having the plurality of juxtaposed tabs extending from a side edge of an interconnecting portion, is integrally joined to a holder body of a synthetic resin, having a plurality of punching holes, by insert molding, thereby forming the bus bar structure, that portion of the interconnecting portion, disposed between the adjacent tabs, being exposed through the corresponding punching hole; and the interconnecting portion is severed at any one of the plurality of punching holes, thereby dividing the bus bar base member into the plurality of bus bars; CHARACTERIZED in that that surface of the interconnecting portion, facing away from the punching holes, is exposed at those regions, corresponding respectively to the punching holes, and those regions, each disposed between the adjacent punching holes, to an outer surface of the holder body over an entire area thereof.

In the invention, a cap is attached to the housing to cover the bus bar structure.

In the invention, a seal member is provided on the housing, and is fitted watertight in an open end of the cap.

(Aspect 1)

That surface of the interconnecting portion, facing away from the punching holes, is exposed at those regions, corresponding respectively to the punching holes, and those regions, each disposed between the adjacent punching holes, to the outer surface of the holder body over the entire area thereof. Therefore, when there is used a die adapted to be held against this exposed surface, there is no need to form any convex portion of a low strength on the die.

(Aspect 2)

The one side (surface) of the interconnecting portion of the bus bar structure is exposed over the entire area thereof, and any partition portion is not provided between the bus bars separated from each other at the severed portion. Therefore, if a foreign matter is deposited on the two bus bars in a manner to bridge this severed portion, the two bus bars are electrically connected to each other. In the invention, however, the bus bar structure is covered with the cap, and therefore the deposition of such a foreign matter is prevented, thus preventing the two bus bars from being electrically connected together.

(Aspect 3)

When the cap is attached to the housing, the seal member is snugly fitted in the open end of the cap in a watertight manner, thereby preventing the intrusion of water into the cap, thus preventing the water from reaching the bus bar structure.

Further, this invention has been made under the above circumstances, and an object of the invention is to provide a construction in which the alignment of tabs are prevented from being adversely affected by an injection pressure during the insert molding of a bus bar structure.

(Aspect 4)

According to a 4th aspect of the present invention, there is provided a joint connector comprising:

a housing having a plurality of juxtaposed metal terminals received therein; and a bus bar structure having a plurality of bus bars each having a plurality of tabs;

wherein when the bus bar structure is attached to the housing, the tabs contact the associated metal terminals, respectively, so that the metal terminals are short-circuited in a predetermined pattern;

wherein a bus bar base member, having the plurality of juxtaposed tabs extending from a side edge of an interconnecting portion, is integrally joined to a holder body of a synthetic resin, having a plurality of punching holes, by insert molding, thereby forming the bus bar structure, that portion of the interconnecting portion, disposed between the adjacent tabs, being exposed through the corresponding punching hole; and the interconnecting portion is severed at any one of the plurality of punching holes, thereby dividing the bus bar base member into the plurality of bus bars;

Characterized in that window holes are formed in the holder body, and opposite end portions of the interconnecting portion, disposed outside a severance-applying portion of the interconnecting portion, are exposed to the exterior through the respective window holes.

(Aspect 5)

According to a 5th aspect of the invention, there is provided a method of producing a joint connector comprising:

a housing having a plurality of juxtaposed metal terminals received therein; and a bus bar structure having a plurality of bus bars each having a plurality of tabs;

wherein when the bus bar structure is attached to the housing, the tabs contact the associated metal terminals, respectively, so that the metal terminals are short-circuited in a predetermined pattern;

wherein a bus bar base member, having the plurality of juxtaposed tabs extending from a side edge of an interconnecting portion, is integrally joined to a holder body of a synthetic resin, having a plurality of punching holes, by insert molding, thereby forming the bus bar structure, that portion of the interconnecting portion, disposed between the adjacent tabs, being exposed through the corresponding punching hole; and the interconnecting portion is severed at any one of the plurality of punching holes, thereby dividing the bus bar base member into the plurality of bus bars;

Characterized in that during the insert molding, opposite end portions of the interconnecting portion, disposed outside a severance-applying region of the interconnecting portion, are held.

(The Invention of Aspect 4)

During the insert molding of the bus bar structure, part of a mold is disposed in spaces, corresponding respectively to the window holes provided respectively at the opposite end portions, to hold the opposite end portions of the interconnecting portion, and therefore the deformation of the opposite end portions of the interconnecting portion by an injection pressure is prevented, and therefore the alignment of the tabs, disposed respectively at the opposite end portions of the interconnecting portion, will not be adversely affected.

(The Invention of Aspect 5)

During the insert molding of the bus bar structure, the mold holds the opposite end portions of the interconnecting portion, and therefore the deformation of the opposite end portions of the interconnecting portion by the injection pressure is prevented, and therefore the alignment of the tabs, disposed respectively at the opposite end portions of the interconnecting portion, will not be adversely affected.

Still further, this invention has been made under the above circumstances, and an object of the invention is to provide a construction in which a cutting mark is prevented from being formed on tabs when cutting a bus bar structure off from a carrier.

(Aspect 6)

According to a 6th aspect of the invention, there is provided a joint connector comprising:

a housing having a plurality of juxtaposed metal terminals provided therein; and a bus bar structure, which includes an electrically-conductive bus bar, having a plurality of juxtaposed tabs extending from an edge of an interconnecting portion, and a holder body of a synthetic resin integrally joined to the bus bar;

wherein when the bus bar structure is attached to the housing, the tabs contact the associated metal terminals, respectively, so that the metal terminals are short-circuited in a predetermined pattern;

wherein there is provided a chain terminal structure having a plurality of the bus bars connected to side edges of a carrier through bridge portions, and the bus bar of the chain terminal structure is integrally joined to the holder body by insert molding, and the bus bar and the holder body, thus integrally joined together, are separated from the carrier by cutting the bridge portions;

Characterized in that each of the bus bars of the chain terminal structure is connected to the carrier through the bridge portions connected to the interconnecting portion of the bus bar.

(Aspect 7)

In a 7th aspect of the invention, the bus bar of the chain terminal structure is connected to the carrier through the bridge portions connected to that edge of the interconnecting portion facing away from the tabs, and cut surfaces of the bridge portions of the bus bar structure are exposed to an outer surface of the holder body, and the bus bar structure is attached to the housing by pushing the outer surface, to which the cut surfaces of the bridge portions are exposed, by the finger; and recesses are formed respectively in those portions of the outer surface of the holder body to which the cut surfaces of the bridge portions are exposed, respectively, and each of the bridge portions is cut at a portion thereof disposed immediately adjacent to a bottom surface of the corresponding recess.

(Aspect 8)

According to an 8th aspect of the invention, there is provided a method of producing a joint connector comprising:

a housing having a plurality of juxtaposed metal terminals provided therein; and a bus bar structure, which includes an electrically-conductive bus bar, having a plurality of juxtaposed tabs extending from an edge of an interconnecting portion, and a holder body of a synthetic resin integrally joined to the bus bar;

wherein when the bus bar structure is attached to the housing, the tabs contact the associated metal terminals, respectively, so that the metal terminals are short-circuited in a predetermined pattern; Characterized by the steps of:

forming, by pressing, a chain terminal structure having a plurality of the bus bars connected to side edges of a carrier through bridge portions, the bridge portions being connected to the edge of the interconnecting portion of the bus bar;

integrally joining the bus bar to the holder body by insert molding; and separating the bus bar and the holder body, thus integrally joined together, from the carrier by cutting the bridge portions, thereby obtaining the bus bar structure.

(The Inventions of Aspects 6 and 8)

Each bus bar of the chain terminal structure is connected to the carrier not through the tabs but via the side edge of the interconnecting portion. Therefore, when the bridge portions are cut or severed, any cutting mark is not formed on the tabs.

(The Invention of Aspect 7)

When attaching the bus bar structure to the housing, the outer surface of the holder body, facing away from the tabs (that is, that surface to which the cut surfaces of the bridge portions are exposed), is pushed by the finger. The cut surface of each bridge portion is disposed inwardly of the outer surface of the holder body, and therefore the finger will not come into contact with the cut surface of the bridge portion.

Figure 1:
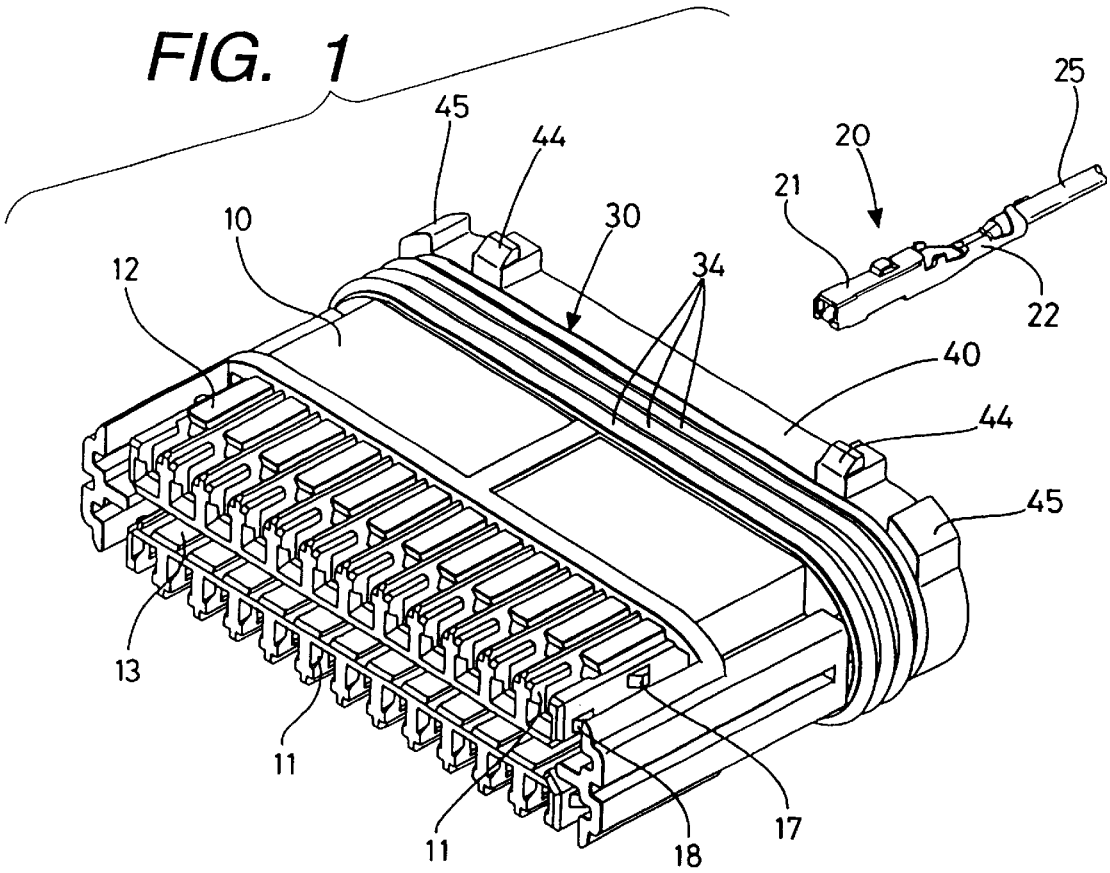
FIG. 1 is a perspective view of an embodiment 1 of the invention, showing a condition in which a seal member and a seal holder are attached to a housing.
Figure 2:
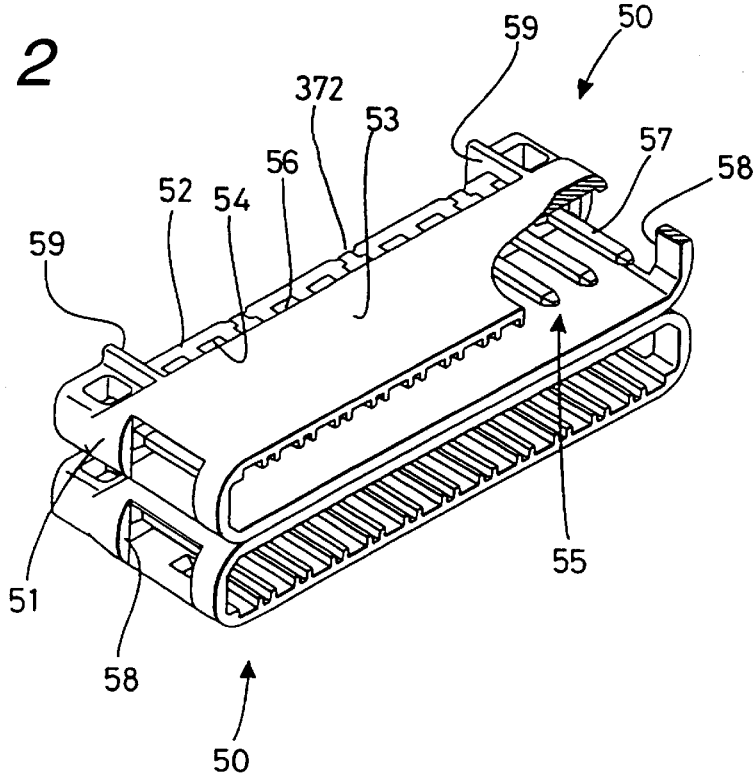
FIG. 2 a partly-broken, perspective view of a bus bar structure.
Figure 3:
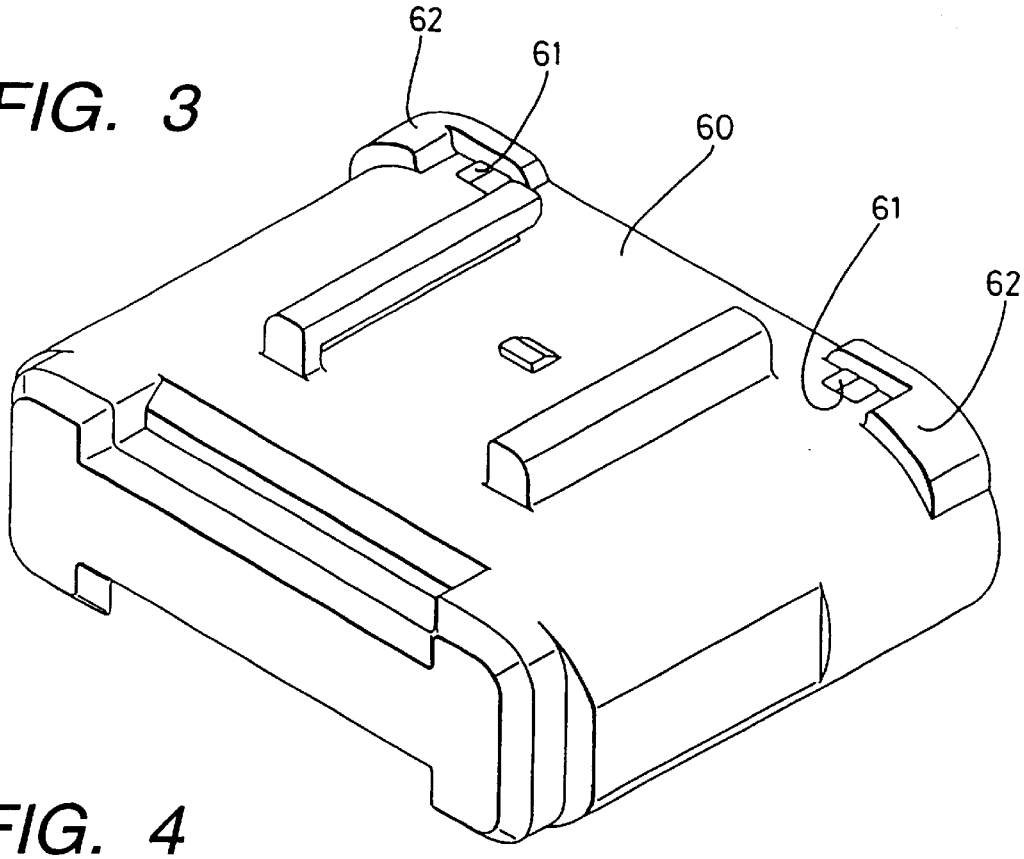
FIG. 3 is a perspective view of a cap.
Figure 4:
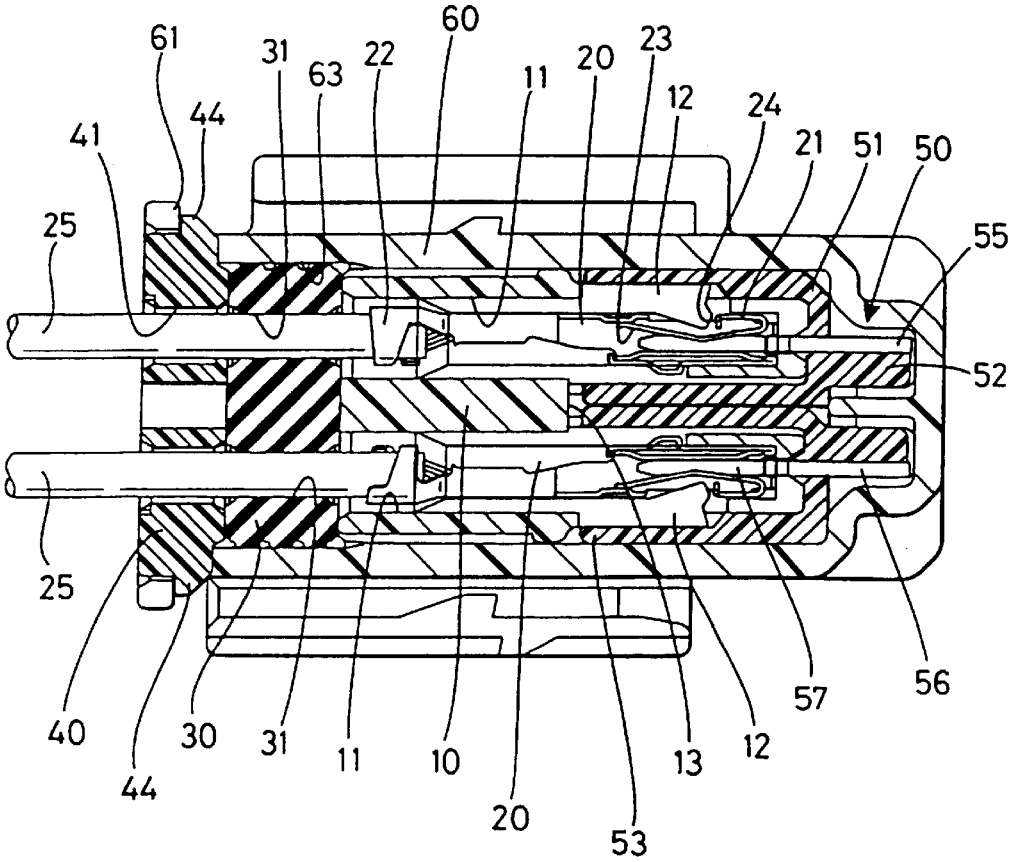
FIG. 4 a cross-sectional view showing an assembled condition.
Figure 5:
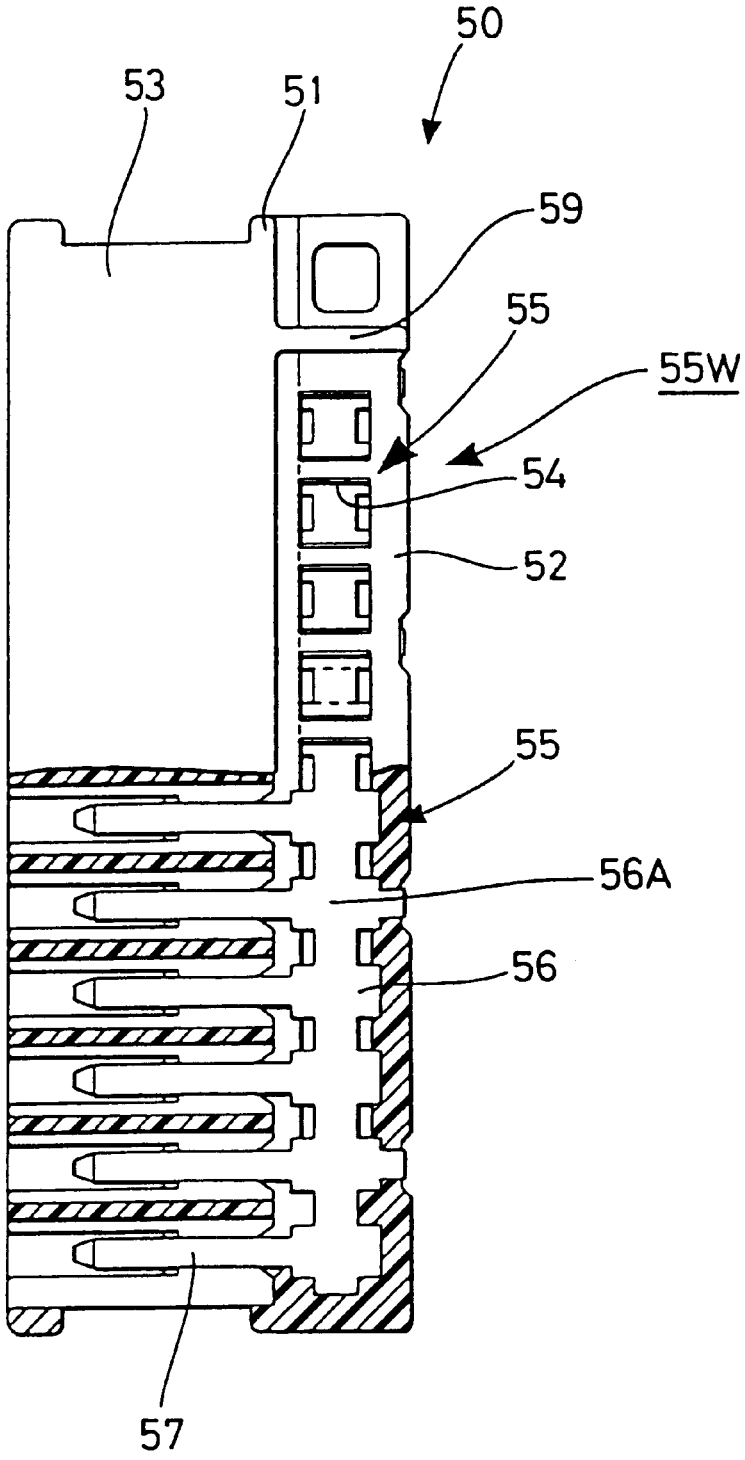
FIG. 5 is a partly-broken, plan view of the bus bar structure.
Figure 6:
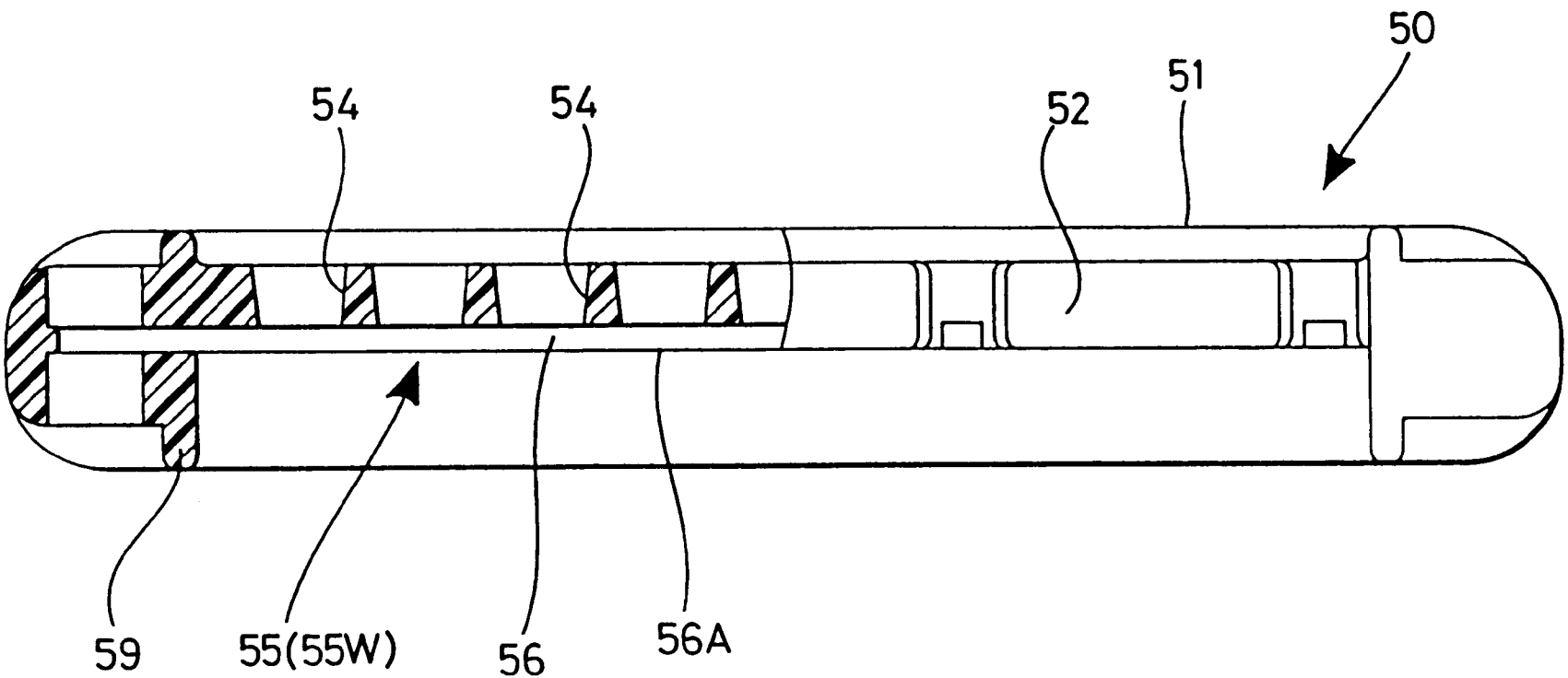
FIG. 6 is a partly-broken, front-elevational view of the bus bar structure.
Figure 7:
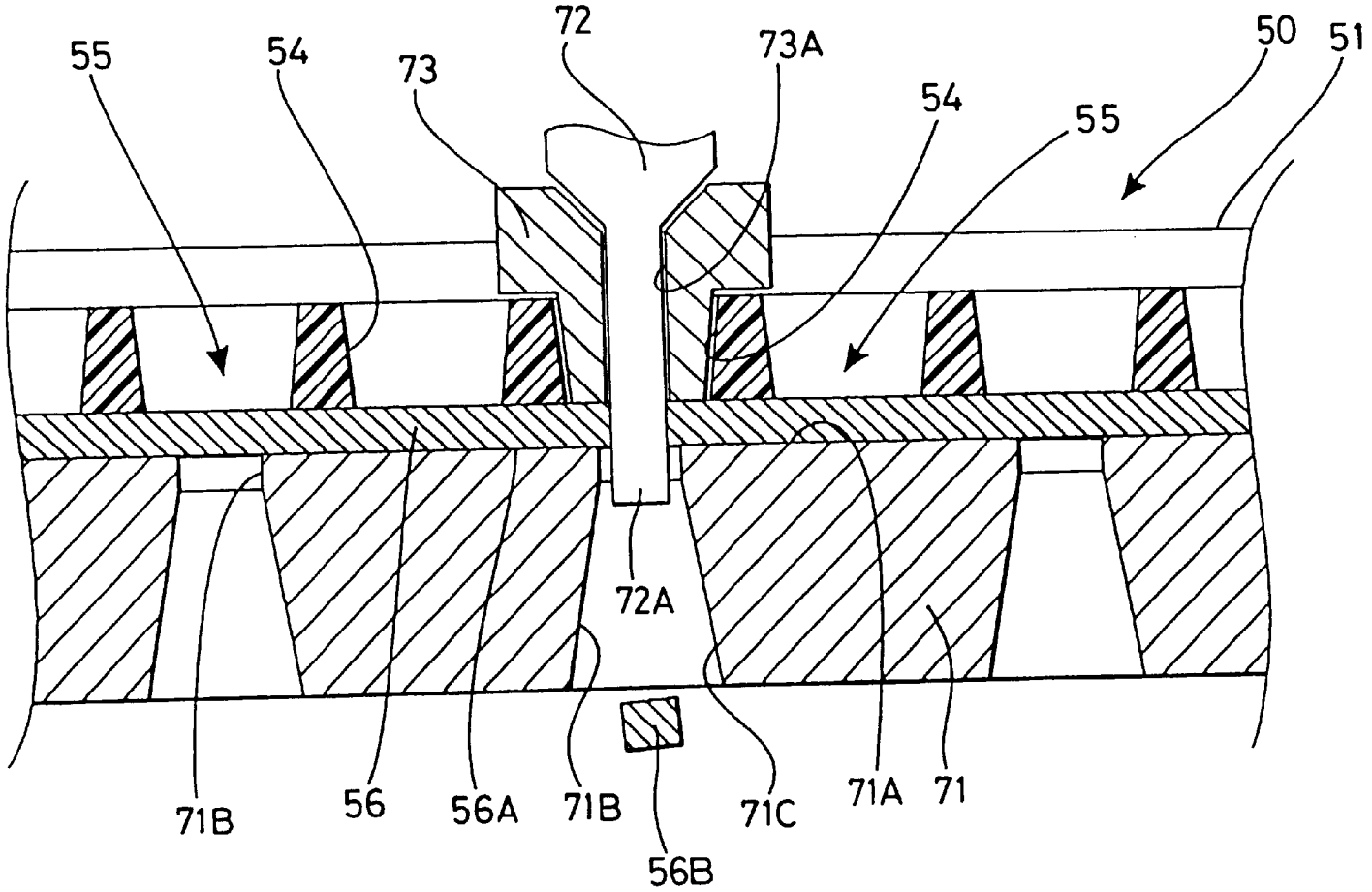
FIG. 7 is a fragmentary, enlarged cross-sectional view showing a condition in which a bus bar base member is severed.
Figure 8:
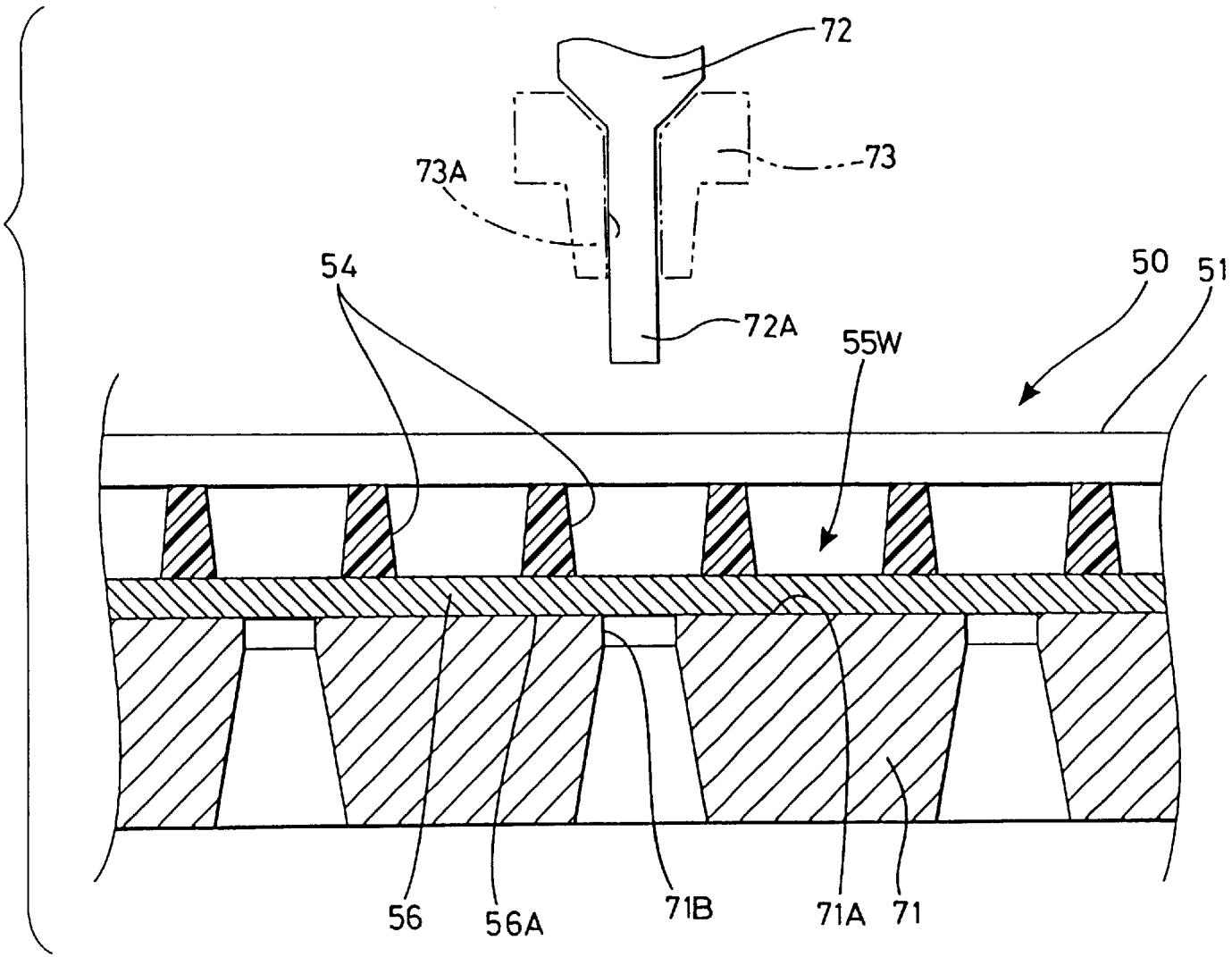
FIG. 8 is a fragmentary, enlarged cross-sectional view showing a condition before the bus bar base member is severed.
Figure 9:
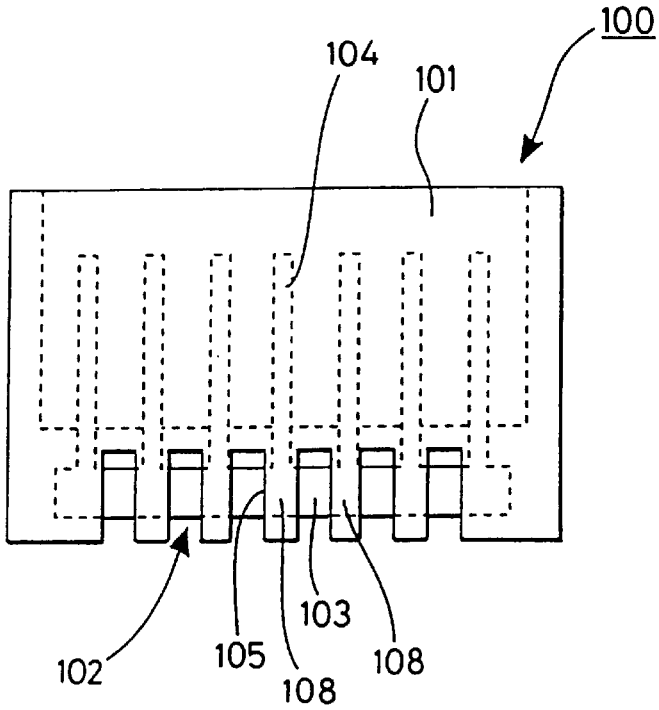
FIG. 9 is a plan view of a conventional bus bar structure.
Figure 10:
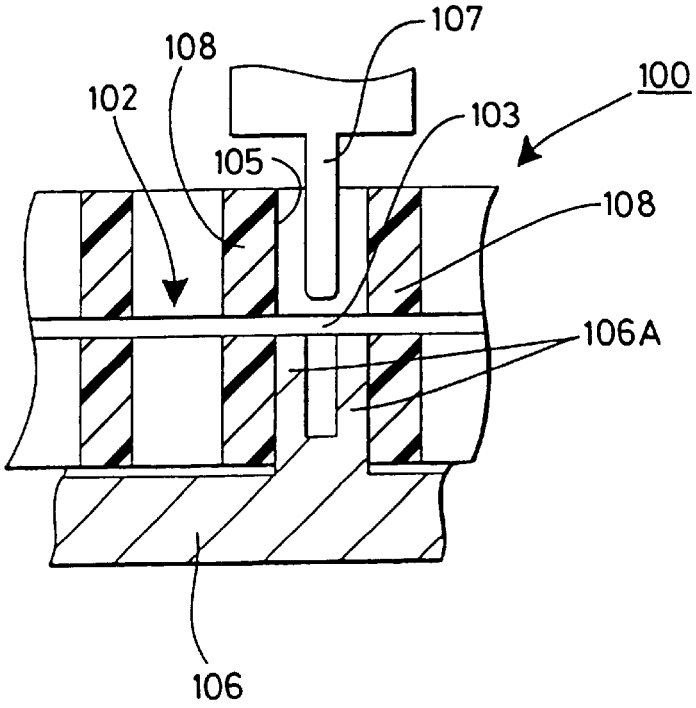
FIG. 10 is a fragmentary, enlarged cross-sectional view showing the manner of severing a conventional bus bar base member.
Figure 11:
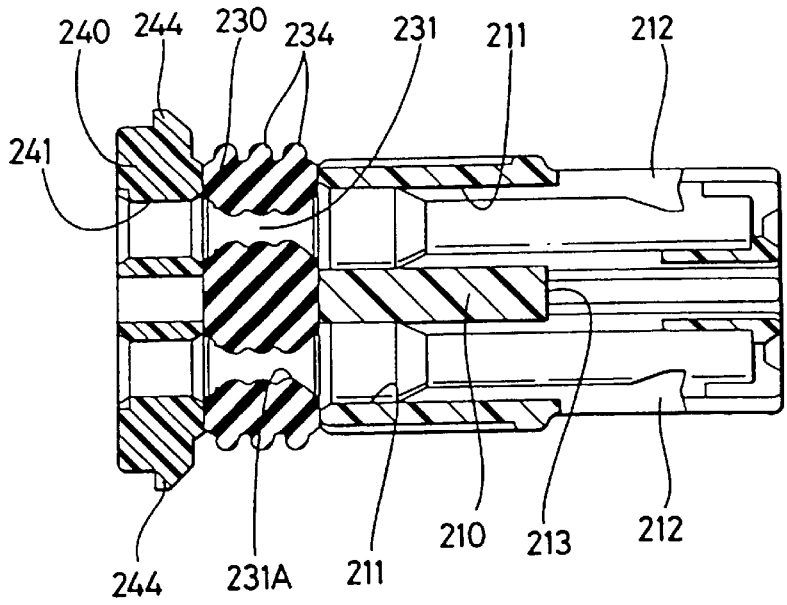
FIG. 11 is a cross-sectional view showing a condition in which the seal member and the seal holder are attached to the housing.
Figure 12:
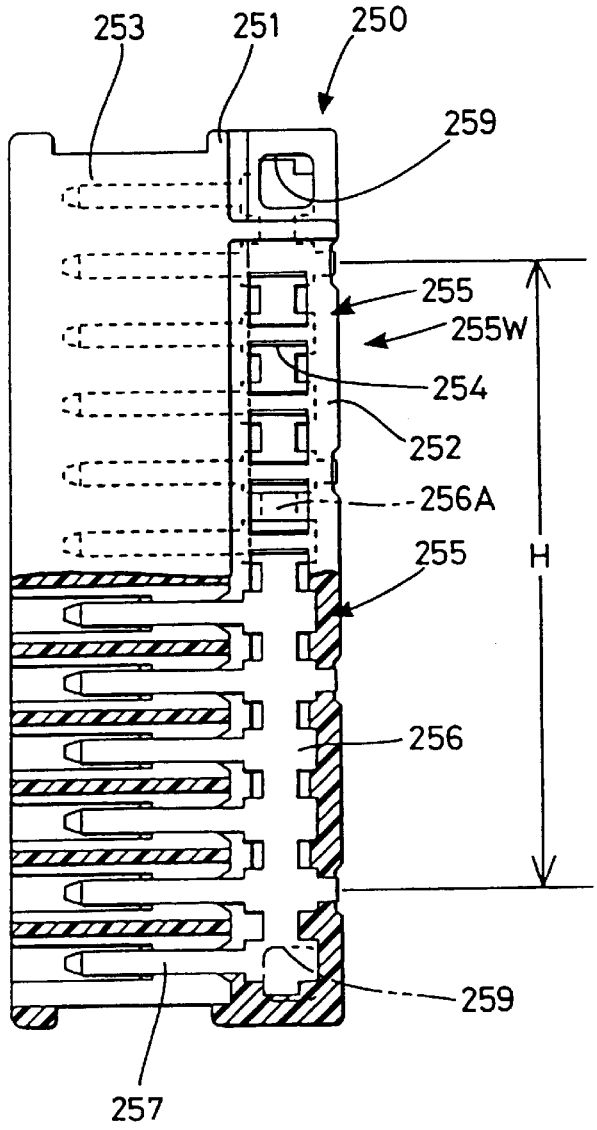
FIG. 12 is a partly-broken, plan view of the bus bar structure.
Figure 13:
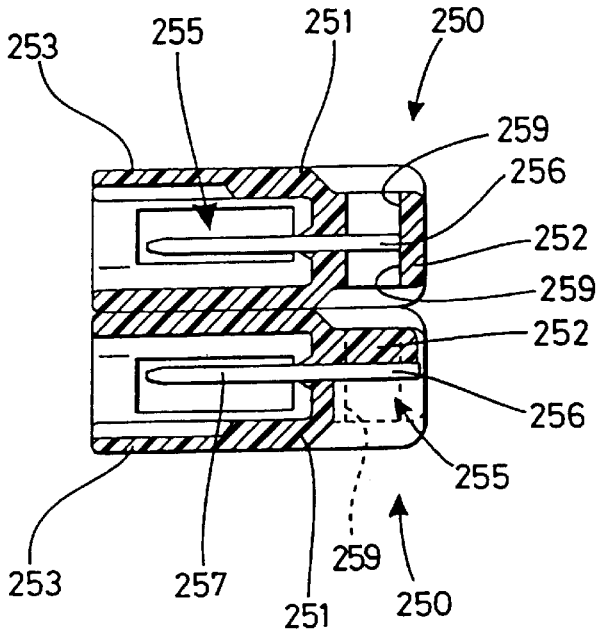
FIG. 13 is across-sectional view of the bus bar structure.
Figure 14:
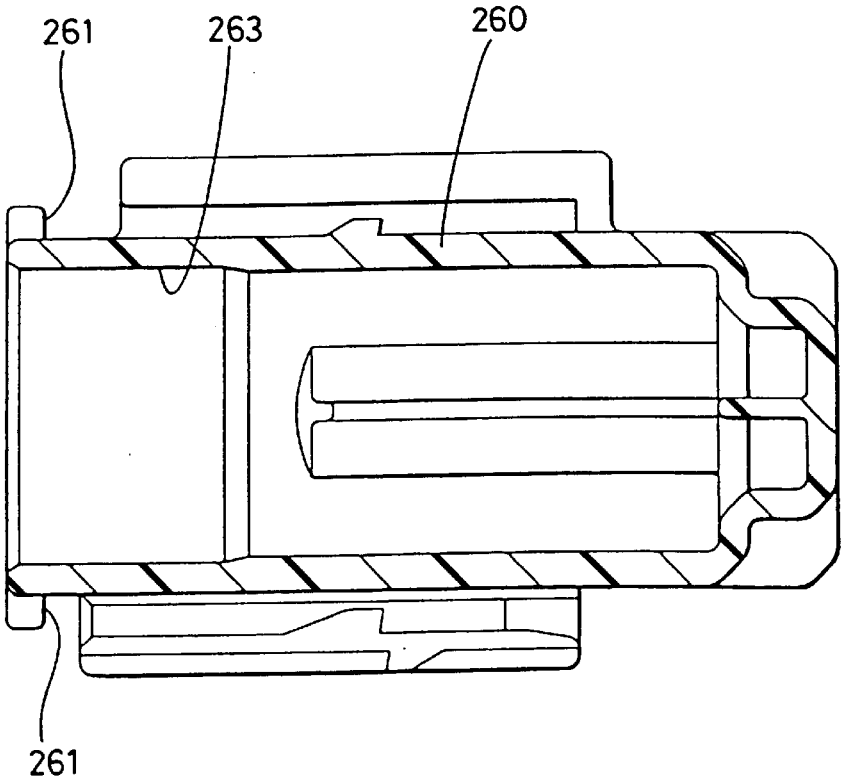
FIG. 14 is a cross-sectional view of a cap.

DETAILED DESCRIPTION OF THE PREFERRED EMBODIMENTS (Embodiment 1)

An embodiment 1 of the present invention will now be described with reference to FIGS. 1 to 8.

A joint connector of this embodiment comprises a housing 10, a plurality of metal terminals 20, a seal member 30, a seal holder 40, two bus bar structures 50, and a cap 60. The plurality of metal terminals 20 are short-circuited in a predetermined pattern by a plurality of bus bars 55.

(Housing 10)

The housing 10 is made of a synthetic resin, and a plurality of cavities (chambers) 11 are formed within the housing 10, and are arranged in two (upper and lower) rows (stages), and these cavities 11 extend through the housing 10 from its front side to its rear side, each row of cavities 11 being arranged at 10 a predetermined pitch. The upper row of cavities 11 are open at their generally front half portions to the upper side of the housing 10 whereas the lower row of cavities 11 are open at their generally front half portions to the lower side of the housing 10. A lance 12, projecting forwardly in a cantilever manner, is 15 formed at each of these open portions. A slot-like recess 13 for receiving peripheral walls of the bus bar structures 50 is formed between the upper and lower rows of cavities 11, and is elongate in a direction of the width of the housing. Notches are formed in an upper wall of the recess 13, and communicate with the upper row of cavities 11, whereas notches are formed in a lower wall of the recess 13, and communicate with the lower row of cavities 11.

(Metal Terminal 20)

The metal terminal 20 is formed by bending a metal sheet blank of a predetermined shape, and a generally front half portion of the metal terminal is formed into a fitting portion 21 of a square tubular shape having open front and rear ends, and a generally rear half portion of the metal terminal is formed into a wire connection portion 22 to which a wire 25 is clamped by pressing. A resilient contact piece 23 for resilient contact with a tab 57 of the bus bar structure 50 is provided within the fitting portion 21, and a retaining hole 24 for retaining engagement with the lance 12 on the housing 10 is formed through a peripheral wall of the fitting portion 21. The metal terminal 20 is passed through the seal holder 40 and the seal member 30, attached to the housing 10, from the rear side of the housing 10, and is inserted into the cavity 11 in the housing 10. Immediately before the metal terminal 20 reaches its proper inserted position, the lance 12 interferes with the outer surface of the peripheral wall of the fitting portion 21, and therefore is elastically deformed outwardly from the housing 10, and then when the metal terminal 20 reaches its proper inserted position, the lance 12 is elastically restored into its original shape to be retainingly engaged in the retaining hole 24, thereby retaining the metal terminal 20 against withdrawal.

(Seal Member 30)

The seal member 30 is made of rubber, and comprises a thick plate of an elongate oval shape, and is held between the rear end surface of the housing 10 and the front end surface of the seal holder 40. A plurality of seal holes 31 are formed through the seal member 30, and are open to the front and rear sides of the seal member 30, and are aligned respectively with the cavities 11 in the housing 10. Each of the seal holes 31 has a circular shape, and three lips 31A of a generally triangular cross-section are formed circumferentially on an inner peripheral surface of the seal hole 31. The inner diameter of each lip 31A is smaller than the outer diameter of the wire 25. The wire 25 is passed through the seal hole 31, and the lips 31A are elastically held in intimate contact with the outer peripheral surface of the wire 25, thereby forming a seal between the wire 25 and the inner surface of the seal hole 31. Three lips 34 of a generally semi-circular cross-section are formed on the outer peripheral surface of the seal member 30, and extend in a direction of the periphery thereof. The lips 34 are elastically held against the inner peripheral surface of the cap 60 to form a seal between the outer peripheral surface of the seal member 30 and the inner peripheral surface of the cap 60, thereby keeping the interior of the cap 60 in a waterproof, dust-proof condition.

(Seal Holder 40)

The seal holder 40 is made of a synthetic resin, and comprises a thick plate of an elongate oval shape like the seal member 30. The lips 34 on the outer peripheral surface of the seal member 30 are a size larger than the outer periphery of the seal holder 40. Terminal insertion holes 41 are formed through the seal holder 40, and extend from the front side thereof to the rear side thereof, and are aligned with the cavities 11, respectively, and also with the seal holes 31, respectively. The metal terminal 20 is inserted through the terminal insertion hole 41 into the cavity 11. Projections (not shown), projecting from the housing 10, extend watertight through the seal member 30, and are retainingly engaged at their distal ends with the seal holder 40, thereby holding the seal member 30 and the seal holder 40 on the housing 10.

Four lock projections 44 are formed on the outer 10 peripheral surface of the seal holder 40, and more specifically two lock projections 44 are formed respectively on opposite end portions of each of upper and lower flat surfaces of the seal holder 40. These lock projections 44 are engagedwith the cap 60, thereby preventing the cap 60 from being disengaged from the housing 10, the seal member 30 and the seal holder 40. A pair of index projections 45 are formed on the outer peripheral surface of the seal holder 40, and are symmetrically disposed respectively at arcuate portions of right and left end portions of the seal holder 40, the index projections 45 projecting upwardly beyond the upper surface of the seal holder 40. These index projections 45 serve as index means by which the upper and lower sides of the housing 10 are determined when inserting the metal terminals 20.

(Bus Bar Structure 50)

Referring to the bus bar structure 50, a bus bar base member 55W of metal is integrally joined to a holder body 51 of a synthetic resin by insert molding, and then this bus bar base member 55W is divided (or severed) into a plurality of bus bars 55. The holder body 51 includes a plate-like holder portion 52 (which is elongate in a direction of the width of the holder body 51), and a flattened, tubular portion 53 extending rearwardly (toward the housing 10) from the plate-like holder portion 52. The bus bar base member 55W includes a plurality of juxtaposed tabs 57 extending from a side edge of a strip-like interconnecting portion 56 in a cantilever manner. The bus bar base member 55W is held in the holder body 51 in such a manner that the interconnecting portion 56 extends along the plate-like holder portion 52 in contiguous relation thereto, with the tabs 57 projecting into the interior of the tubular portion 53.

In the description given below, "the upper and lower sides" of the bus bar structure 50 will be referred to on the basis of the bus bar structure (shown in FIGS. 6 to 8) to be mounted in the lower stage of the housing 10.

A plurality of punching holes 54 are formed in the plate-like holder portion 52, and are open to an upper surface thereof. The punching hole 54 is provided at that portion of the interconnecting portion 56 disposed between the adjacent tabs 57. At a lower surface of the plate-like holder portion 52, a lower surface of the interconnecting portion 56 is exposed at that region (i.e., those regions, corresponding respectively to the punching holes 54, and those regions each disposed between the adjacent punching holes 54), which is to be severed, over an entire area thereof to provide an entire exposure surface 56A. The entire exposure surface 56A is disposed flush with the lower surface of the plate-like holder portion 52. Ribs 59 (serving as positioning means which is one feature of the invention) are formed on and project downwardly respectively from those portions of the plate-like holder portion 52 disposed adjacent respectively to the opposite (right and left) ends of the entire exposure surface.

After the insert molding in the process of production of the bus bar structure 50, that portion (i.e., part) of the interconnecting portion 56, exposed to any one of the punching holes 54 selected in accordance with a predetermined short-circuiting pattern, is punched at this punching hole 54, using a die 71 and a punch 72, and as a result the interconnecting portion 56 is severed, so that the bus bar base member is divided (or severed) into a plurality of bus bars 55. Each bus bar 55 has at least two tabs 57, and the metal terminals 20 are connected respectively to these tabs 57, and therefore the plurality of metal terminals 20 for each bus bar 55 are short-circuited. The means for severing the interconnecting portion 56 will be more fully described hereafter.

The bus bar structures 50 are attached to the housing 10 from the front side thereof in such a manner that the upper row of cavities 11 and the lower row of cavities 11 are covered with the tubular portions 53 of these bus bar structures 50, respectively. In this attached condition, the tabs 57 are connected to the metal terminals 20, respectively. The holder bodies 51 have different colors so that the short-circuiting patterns can be distinguished. The holder body 51 is a symmetrical with respect to a median plane thereof between the upper and lower surfaces thereof. Therefore, by confirming the color of the holder body 51 and the upper and lower sides of the holder body 51, the proper bus bar structures 50 can be attached to the housing in their respective proper postures, and therefore the group of metal terminals 20 can be short-circuited in a proper short-circuiting pattern.

Guide grooves 58 are formed respectively in opposite (right and left) sides of the tubular portion 53, and extend in the forward-rearward direction, and two pairs of front and rear retaining projections 17 and 18, corresponding respectively to the guide grooves 58, are formed on each of the upper and lower portions of the housing 10. When a rear edge of each guide groove 58 and the rear end of the tubular portion 53 are retainingly engaged with opposed surfaces of the associated retaining projections 17 and 18, respectively, the bus bar structure 50 is held in a provisionally-retained position. When the front and rear edges of each guide groove 58 are retainingly engaged with the rear surface of the retaining projection 17 and the front surface of the retaining projection 18, the bus bar structure 50 is held in a properly-attached position.

(Cap 60)

The cap 60 is made of a synthetic resin, and has a tubular shape of an elongate oval cross-section (as seen from the front side thereof) with a closed bottom. Lock holes 61 are formed in a peripheral edge portion of the open end of the cap 60, and the lock projections 44 on the seal holder 40 can be retainingly engaged in these lock holes 61, respectively. When the lock projections 44 are engaged in the lock holes 61, respectively, the cap 60 is locked in its attached condition. Outwardly-bulging relief portions 62 for avoiding the interference of the cap 60 with the index projections are formed on the peripheral edge portion of the open end of the cap 60. That portion of an inner peripheral surface of the cap 60, disposed adjacent to the open end thereof, serves as a seal surface against which the lips 34 on the outer peripheral surface of the seal member 30 can be elastically held.

(Assembling of the Parts)

The procedure of assembling the above parts are as follows. First, the seal member 30 and the seal holder 40 are attached to the housing 10, and the metal terminals 20 are inserted into the respective terminal insertion holes 41, and are passed through the respective seal holes 31, and are inserted into the respective cavities 11. Then, each bus bar structure 50 is attached to the housing 10, and is held in the provisionally-retained position. In this condition, this assembly is set in an assembling apparatus (not shown), and the bus bar structure 50 is forced from the provisionally-retained position into the properly-attached position. As a result, the tabs 57 are connected to the associated metal terminals 20, respectively, so that these metal terminals 20 are short-circuited in the predetermined pattern.

(Means for Severing the Bus Bar Base Member Into a Plurality of Bus Bars)

As described above, the bus bar structure 50 is insert molded, using the bus bar base member 55W common to all short-circuiting patterns, and thereafter the bus bar base member 55W is divided (or severed) into a plurality of bus bars 55. In this severing operation, the die 71, the punch 72 and a stripper 73 are used.

The die 71 is held against the lower surface (the entire exposure surface 56A) of the interconnecting portion 56, exposed to the lower surface of the plate-like holder portion 52, from the lower side, and an upper surface 71A of the die 71 for abutment against the entire exposure surface 56A is flat as a whole. A plurality of juxtaposed recesses 71B are formed in the upper surface 71A of the die 71 so as to be aligned with the punching holes 54, respectively. A lower end of each recess 71B serves as a discharge port 71C open to the lower surface of the die 71, and a piece 56B, punched or removed from the interconnecting portion 56, is discharged to the exterior through this discharge port 71C. The recesses 71B are formed so as to be aligned with all of the punching holes 54, respectively, and therefore the die 71 can be used as the device common to all of the short-circuiting patterns. The ribs 59 are held respectively against opposite ends (not shown) of the die 71 to prevent the movement of the die 71 in the right-left direction, and therefore the recesses 71B are positioned and aligned relative to the punching holes 54, respectively.

The punch 72 has a downwardly-directed, severing projection 72A, and this severing projection 72A is driven into the punching hole 54 to punch a portion of the interconnecting portion 56, thereby severing this interconnecting portion 56. The severing projection 72A can be fitted into the recess 71B in the die 71, with a very small clearance formed therebetween.

The stripper 73 has a generally square tubular shape, and can be fitted in the punching hole 54 against movement. The interior of the stripper 73 is formed into a guide hole 73A, and in the severing operation, the severing projection 72A, while guided by the guide hole 73A, passes through this guide hole 73A.

(Operation and Effects of this Embodiment)

The entire exposure surface 56A (those regions, corresponding respectively to the punching holes 54, and those regions each disposed between the adjacent punching holes 54) of the interconnecting portion 56, facing away from the punching holes 54, is exposed to the outer surface of the holder body 51, and any convex portion (that is, any portion of a low strength) does not need to be formed on the upper surface 71A of the die 71 which is to be held against the entire exposure surface 56A.

In the range of the entire exposure surface 56A of the interconnecting portion 56 against which the die 71 is to be held, the positioning of the die 71 can not be effected by engaging any resin portion, formed on the holder body 51, with the die 71. However, since the ribs S9 are formed respectively at the opposite end portions of the holder body 51 disposed outside the range of the entire exposure surface 56A, the positioning of the die 71 can be effected. Therefore, the recesses 71B in the die 71 can be aligned with the respective punching holes 54, and also the selected recess 71B can be aligned with the severing projection 72A of the punch 72.

The region of the interconnecting portion 56 to be severed is exposed as the entire exposure surface 56A over the entire area thereof, and any partition portion is not provided between the two bus bars 55 separated from each other by the severing operation. Therefore, if a foreign matter is deposited on the two bus bars in a bridging manner, the two bus bars are electrically connected to each other. In this embodiment, however, the whole of the bus bar structure 50 is covered with the cap 60, and therefore the deposition of such a foreign matter is prevented, thus preventing the two bus bars from being electrically connected together. And besides, the cap 60, snugly fitted watertight on the outer periphery of the seal member 30, achieves not only the dust-proof function but also the waterproof function.

(Other Embodiments)

The present invention is not limited to the above description and the drawings, and for example, the following embodiments fall within the scope of the invention. Further, various modifications other than the following can be made without departing from the scope of the invention.

(1) Although the above embodiment is directed to the shield connector of the waterproof type, the invention can be applied to a joint connector of the non-waterproof type.

(2) In the above embodiment, although the cap has the waterproof function, the cap of the invention can have only the dust-proof function.

(3) In the above embodiment, although the dust-proof cap is provided for preventing the deposition of a foreign matter on the bus bar structure, the provision of the cap can be omitted in the invention if any other foreign matter deposition prevention means is provided.

(4) In the above embodiment, although that surface of the interconnecting portion, exposed over the entire area thereof, is disposed flush with the outer surface of the holder body, the two surfaces may be stepped with respect to each other in the invention.

(Embodiment 2)

An embodiment 2 of the present invention will now be described with reference to FIGS. 1 to 14.

A joint connector of this embodiment comprises a housing 210, a plurality of metal terminals 220, a seal member 230, a seal holder 240, two bus bar structures 250, and a cap 260. The plurality of metal terminals 220 are short-circuited in a predetermined pattern by a plurality of bus bars 255.

(Housing 210)

The housing 210 is made of a synthetic resin, and a plurality of cavities (chambers) 211 are formed within the housing 210, and are arranged in two (upper and lower) rows (stages), and these cavities 211 extend through the housing 210 from its front side to its rear side, each row of cavities 211 being arranged at a predetermined pitch. The upper row of cavities 211 are open at their generally front half portions to the upper side of the housing 210 whereas the lower row of cavities 211 are open at their generally front half portions to the lower side of the housing 210. A lance 212, projecting forwardly in a cantilever manner, is formed at each of these open portions. A slot-like recess 213 for receiving peripheral walls of the bus bar structures 250 is formed between the upper and lower rows of cavities 211, and is elongate in a direction of the width of the housing. Notches are formed in an upper wall of the recess 213, and communicate with the upper row of cavities 211, whereas notches are formed in a lower wall of the recess 213, and communicate with the lower row of cavities 211.

(Metal Terminal 220)

The metal terminal 220 is formed by bending a metal sheet blank of a predetermined shape, and a generally front half portion of the metal terminal is formed into a fitting portion 221 of a square tubular shape having open front and rear ends, and a generally rear half portion of the metal terminal is formed into a wire connection portion 222 to which a wire 225 is clamped by pressing. A resilient contact piece 223 for resilient contact with a tab 257 of the bus bar structure 250 is provided within the fitting portion 221, and a retaining hole 224 for retaining engagement with the lance 212 on the housing 210 is formed through a peripheral wall of the fitting portion 221. The metal terminal 220 is passed through the seal holder 240 and the seal member 230, attached to the housing 210, from the rear side of the housing 210, and is inserted into the cavity 211 in the housing 210. Immediately before the metal terminal 220 reaches its proper inserted position, the lance 212 interferes with the outer surface of the peripheral wall of the fitting portion 221, and therefore is elastically deformed outwardly from the housing 210, and then when the metal terminal 220 reaches its proper inserted position, the lance 212 is elastically restored into its original shape to be retainingly engaged in the retaining hole 224, thereby retaining the metal terminal 220 against withdrawal.

(Seal Member 230)

The seal member 230 is made of rubber, and comprises a thick plate of an elongate oval shape, and is held between the rear end surface of the housing 210 and the front end surface of the seal holder 240. A plurality of seal holes 231 are formed through the seal member 230, and are open to the front and rear sides of the seal member 230, and are aligned respectively with the cavities 211 in the housing 210. Each of the seal holes 231 has a circular shape, and three lips 231A of a generally triangular cross-section are formed circumferentially on an inner peripheral surface of the seal hole 231. The inner diameter of each lip 231A is smaller than the outer diameter of the wire 225. The wire 225 is passed through the seal hole 231, and the lips 231A are elastically held in intimate contact with the outer peripheral surface of the wire 225, thereby forming a seal between the wire 225 and the inner surface of the seal hole 231. Three lips 234 of a generally semi-circular cross-section are formed on the outer peripheral surface of the seal member 230, and extend in a direction of the periphery thereof. The lips 234 are elastically held against the inner peripheral surface of the cap 260 to form a seal between the outer peripheral surface of the seal member 30 and the inner peripheral surface of the cap 260.

(Seal Holder 240)

The seal holder 240 is made of a synthetic resin, and comprises a thick plate of an elongate oval shape like the seal member 230. The lips 234 on the outer peripheral surface of the seal member 230 are a size larger than the outer periphery of the seal holder 240. Terminal insertion holes 241 are formed through the seal holder 240, and extend from the front side thereof to the rear side thereof, and are aligned with the cavities 211, respectively, and also with the seal holes 231, respectively. The metal terminal 220 is inserted through the terminal insertion hole 241 into the cavity 211. Projections (not shown), projecting from the housing 210, extend watertight through the seal member 230, and are retainingly engaged at their distal ends with the seal holder 240, thereby holding the seal member 230 and the seal holder 240 on the housing 210.

Four lock projections 244 are formed on the outer peripheral surface of the seal holder 240, and more specifically two lock projections 244 are formed respectively on opposite end portions of each of upper and lower flat surfaces of the seal holder 240. These lock projections 244 are engaged with the cap 260, thereby preventing the cap 260 from being disengaged from the housing 210, the seal member 230 and the seal holder 240. A pair of index projections 245 are formed on the outer peripheral surface of the seal holder 240, and are symmetrically disposed respectively at arcuate portions of right and left end portions of the seal holder 240, the index projections 245 projecting upwardly beyond the upper surface of the seal holder 240. These index projections 245 serve as index means by which the upper and lower sides of the housing 210 are determined when inserting the metal terminals 220.

(Bus Bar Structure 250)

Referring to the bus bar structure 250, a bus bar base member 255W of metal is integrally joined to a holder body 251 of a synthetic resin by insert molding, and then this bus bar base member 255W is divided (or severed) into a plurality of bus bars 255. The holder body 251 includes a plate-like holder portion 252 (which is elongate in a direction of the width of the holder body 251), and a flattened, tubular portion 253 extending rearwardly (toward the housing 210) from the plate-like holder portion 252. The bus bar base member 255W includes a plurality of juxtaposed tabs 257 extending from a side edge of a strip-like interconnecting portion 256 in a cantilever manner. The bus bar base member 255W is held in the holder body 251 in such a manner that the interconnecting portion 256 extends along the plate-like holder portion 252 in contiguous relation thereto, with the tabs 257 projecting into the interior of the tubular portion 253. Punching holes 254 are formed in the plate-like holder portion 252, and the punching hole 254 is provided at that portion of the interconnecting portion 256 disposed between the adjacent tabs 257. After the insert molding in the process of production of the bus bar structure 250, that portion (i.e., part) of the interconnecting portion 256, exposed to any one of the punching holes 254 selected in accordance with a predetermined short-circuiting pattern, is punched at this punching hole 254, using a punch and a die (not shown), and as a result the interconnecting portion 256 is severed, so that the bus bar base member is divided (or severed) into a plurality of bus bars 255. Each bus bar 255 has at least two tabs 257, and the metal terminals 220 are connected respectively to these tabs 257, and therefore the plurality of metal terminals 220 for each bus bar 255 are short-circuited.

The interconnecting portion 256 will not be severed at that portion thereof disposed between each endmost tab 257 (disposed at each end of the bus bar base member) and the adjoining tab 257. Therefore, the punching holes 254 are formed only at a severance-applying region H of the interconnecting portion 256 (extending between those tabs 257 disposed adjacent respectively to the opposite endmost tabs 257), and any punching hole 254 is not formed at the opposite end regions disposed outside the severance-applying region H.

Window holes 259 are formed respectively in the opposite end portions of the plate-like holder portion 252 in which any punching hole 254 is not formed. The window holes 259 are disposed respectively in registry with the proximal end portions of the opposite endmost tabs 257 disposed respectively at the opposite ends of the interconnecting portion 256, and these window holes 259 are open to the upper and lower surfaces of the plate-like holder portion 252 of the holder body 251. The interconnecting portion 256 is disposed generally centrally of the height of the window holes 259. In other words, the upper and lower surfaces of the interconnecting portion 256 are exposed to the exterior through each of the window holes 259.

The bus bar structures 250 are attached to the housing 210 from the front side thereof in such a manner that the upper row of cavities 211 and the lower row of cavities 211 are covered with the tubular portions 253 of these bus bar structures 250, respectively. In this attached condition, the tabs 257 are connected to the metal terminals 220, respectively. The holder bodies 251 have different colors so that the short-circuiting patterns can be distinguished. The holder body 251 is asymmetrical with respect to a median plane thereof between the upper and lower surfaces thereof. Therefore, by confirming the color of the holder body 251 and the upper and lower sides of the holder body 251, the proper bus bar structures 250 can be attached to the housing 210 in their respective proper postures, and therefore the group of metal terminals 220 can be short-circuited in a proper short-circuiting pattern.

Guide grooves 258 are formed respectively in opposite (right and left) sides of the tubular portion 253, and extend in the forward-rearward direction, and two pairs of front and rear retaining projections 217 and 218, corresponding respectively to the guide grooves 258, are formed on each of the upper and lower portions of the housing 210. When a rear edge of each guide groove 258 and the rear end of the tubular portion 253 are retainingly engaged with opposed surfaces of the associated retaining projections 217 and 218, respectively, the bus bar structure 250 is held in a provisionally-retained position. When the front and rear edges of each guide groove 258 are retainingly engaged with the rear surface of the retaining projection 217 and the front surface of the retaining projection 218, the bus bar structure 250 is held in a properly-attached position.

(Cap 260)

The cap 260 is made of a synthetic resin, and has a tubular shape of an elongate oval cross-section (as seen from the front side thereof) with a closed bottom. Lock holes 261 are formed in a peripheral edge portion of the open end of the cap 260, and the lock projections 244 on the seal holder 240 can be retainingly engaged in these lock holes 261, respectively. When the lock projections 244 are engaged in the lock holes 261, respectively, the cap 260 is locked in its attached condition. Outwardly-bulging relief portions 262 for avoiding the interference of the cap 260 with the index projections are formed on the peripheral edge portion of the open end of the cap 260. That portion of an inner peripheral surface of the cap 260, disposed adjacent to the open end thereof, serves as a seal surface against which the lips 234 on the outer peripheral surface of the seal member 230 can be elastically held.

(Assembling of the Parts)

The procedure of assembling the above parts are as follows. First, the seal member 230 and the seal holder 240 are attached to the housing 210, and the metal terminals 220 are inserted into the respective terminal insertion holes 241, and are passed through the respective seal holes 231, and are inserted into the respective cavities 211. Then, each bus bar structure 250 is attached to the housing 210, and is held in the provisionally-retained position. In this condition, this assembly is set in an assembling apparatus (not shown), and the bus bar structure 250 is forced from the provisionally-retained position into the properly-attached position. As a result, the tabs 257 are connected to the associated metal terminals 220, respectively, so that these metal terminals 220 are short-circuited in the predetermined pattern.

(Operation and Effects of this Embodiment)

Figure 15:
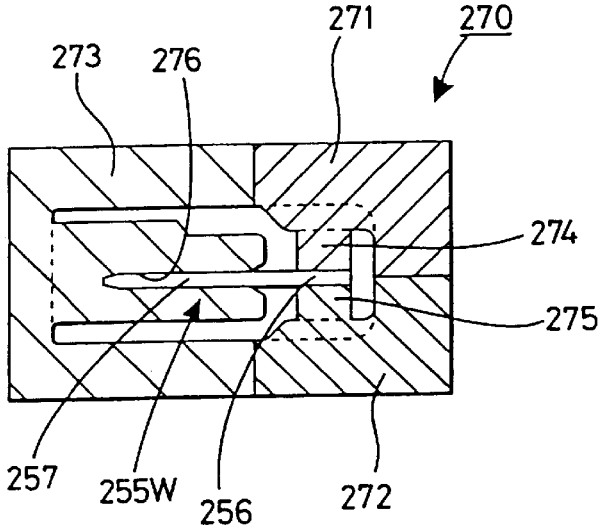
FIG. 15 is a cross-sectional view showing the process of insert molding of the bus bar structure.
Figure 16:
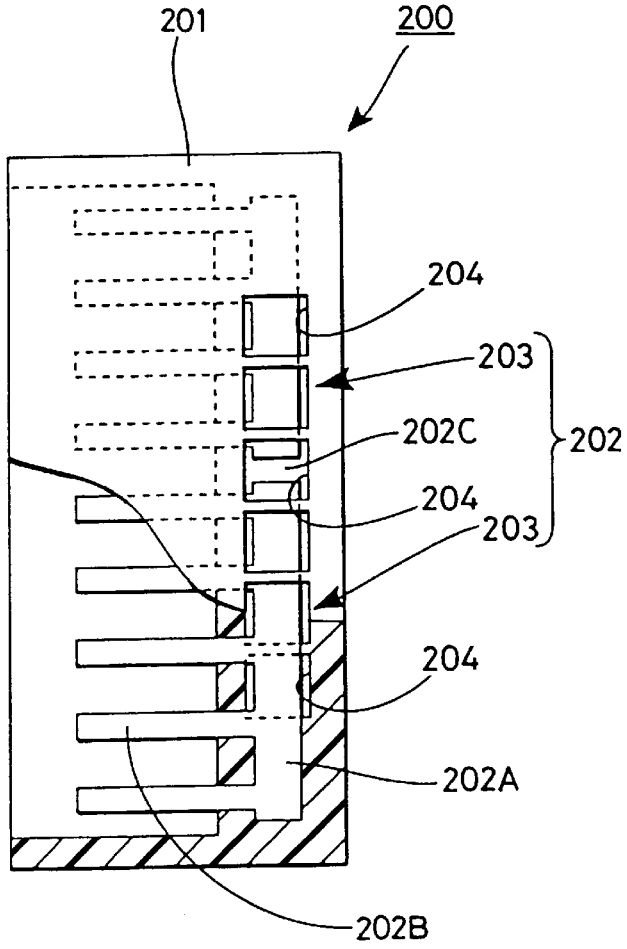
FIG. 16 is a partly-broken, plan view of a conventional bus bar structure.
Figure 17:
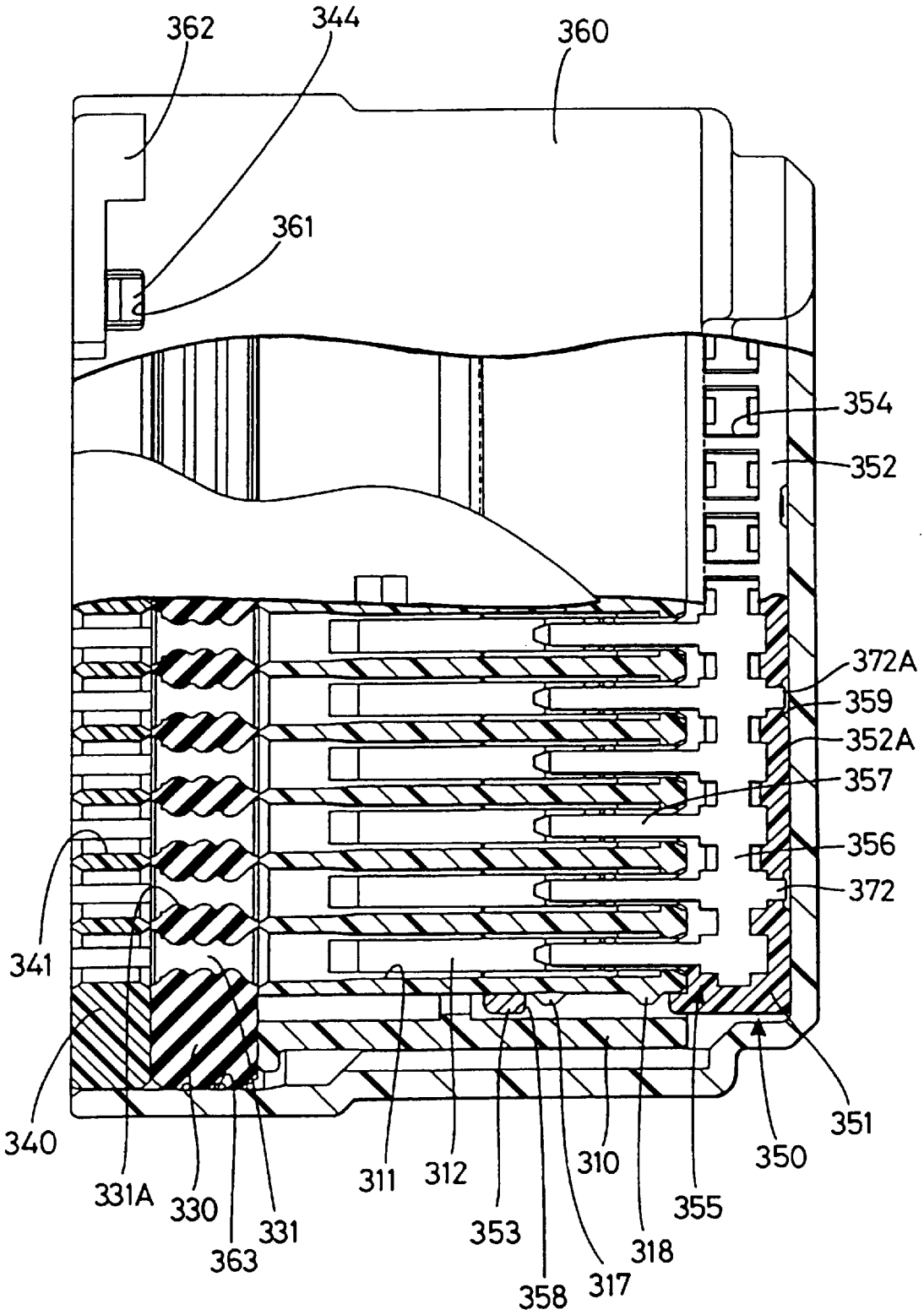
FIG. 17 a horizontal cross-sectional view showing an assembled condition.
Figure 18:
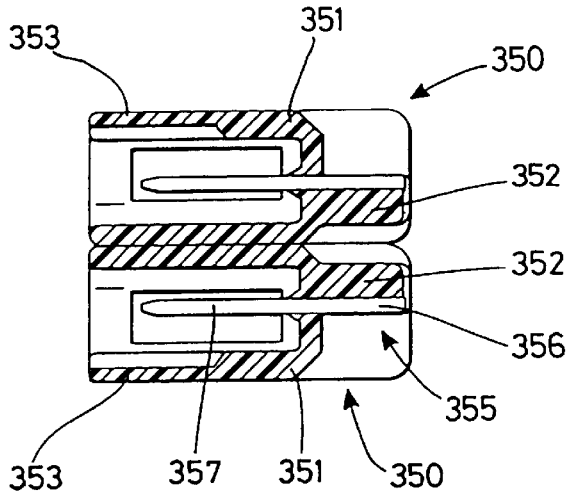
FIG. 18 is a vertical cross-sectional view of the bus bar structure.

In the insert molding during the process of production of the bus bar structure 250, there is used a mold 270 as shown in FIG. 15. The mold 270 comprises an upper mold 271 for molding the upper surface of the plate-like holder 252, a lower mold 272 for molding the lower surface of the plate-like holder portion 252, and a slide mold 273 for molding the tubular portion 253. Upper portion-molding projections 274 for respectively molding upper halves of the window holes 259 are formed on the upper mold 271, and lower portion-molding projections 275 for respectively molding the lower halves of the window holes 259 are formed on the lower mold 272. In a mold-closed condition, a gap is formed between the opposed surface of each pair of upper and lower projections 274 and 275, and the opposite end portions (at which the window holes 259 are to be formed, respectively) of the interconnecting portion 256 are received in these gaps, respectively, in such a manner that each of these opposite end portions is firmly held between the corresponding pair of upper and lower projections 274 and 275 against movement. Although not shown in the drawings, the interconnecting portion 256 is firmly held between the upper and lower dies 271 and 272 not only at the regions where the window holes 259 are to be formed, but also at the region where the punching holes 254 are to be formed. The tabs 257 are fitted respectively in recesses 276 in the slide mold 273, and therefore are held against movement.

In this condition, a molten resin material is injected into the mold 270 from a gate (not shown), and is filled in a mold cavity, defined by the upper mold 271, the lower mold 272 and the slide mold 273, so that the bus bar structure 250, having the bus bar base member 255W integrally joined to the holder body 251, is molded. Then, the bus bar structure 250 is removed from the mold 270, and a portion 256A of the interconnecting portion 256 is severed or removed at the punching hole 254, so that the bus bar base member 255W is divided into the plurality of bus bars 255.

As described above, in this embodiment, during the insert molding of the bus bar structure 250, the interconnecting portion 256 of the bus bar base member 255W is held against movement by the mold 270 not only at the region (severance-applying region H) where the punching holes 254 are formed, but also at the opposite end regions (where the window holes 259 are formed) disposed outside the region where the punching holes 254 are formed. Namely, the interconnecting portion 256 is held against movement over the entire length thereof, and therefore the interconnecting portion 256 will not be deformed by the injection pressure, and therefore an error in the alignment of the tabs 257 due to the deformation of the interconnecting portion 256 is positively prevented.

(Other Embodiments)

The present invention is not limited to the above description and the drawings, and for example, the following embodiments fall within the scope of the invention. Further, various modifications other than the following can be made without departing from the scope of the invention.

(1) In the above embodiment, although the window holes are disposed in registry with the opposite endmost tabs, respectively, each window hole may be disposed in offset relation to the corresponding endmost tab, that is, disposed between the endmost tab and its adjoining tab, and alternatively each window hole may be formed into a larger size over the range generally covering the endmost tab and its adjoining tab.

(2) Although the above embodiment is directed to the joint connector of the waterproof type, the invention can be applied to a joint connector of the non-waterproof type.

(Embodiment 3)

An embodiment 3 of the present invention will now be described with reference to FIGS. 7 to 21.

A joint connector of this embodiment comprises a housing 310, a plurality of metal terminals 320, a seal member 330, a seal holder 340, two bus bar structures 350, and a cap 360. The plurality of metal terminals 320 are short-circuited in a predetermined pattern by a plurality of bus bars 355.

(Housing 310)

The housing 310 is made of a synthetic resin, and a plurality of cavities (chambers) 311 are formed within the housing 310, and are arranged in two (upper and lower) rows (stages), and these cavities 311 extend through the housing 310 from its front side to its rear side, each row of cavities 311 being arranged at a predetermined pitch. The upper row of cavities 311 are open at their generally front half portions to the upper side of the housing 310 whereas the lower row of cavities 311 are open at their generally front half portions to the lower side of the housing 310. A lance 312, projecting forwardly in a cantilever manner, is formed at each of these open portions. A slot-like recess 313 for receiving peripheral walls of the bus bar structures 350 is formed between the upper and lower rows of cavities 311, and is elongate in a direction of the width of the housing. Notches are formed in an upper wall of the recess 313, and communicate with the upper row of cavities 311, whereas notches are formed in a lower wall of the recess 313, and communicate with the lower row of cavities 311.

(Metal Terminal 320)

The metal terminal 320 is formed by bending a metal sheet blank of a predetermined shape, and a generally front half portion of the metal terminal is formed into a fitting portion 321 of a square tubular shape having open front and rear ends, and a generally rear half portion of the metal terminal is formed into a wire connection portion 322 to which a wire 325 is clamped by pressing. A resilient contact piece 323 for resilient contact with a tab 357 of the bus bar structure 350 is provided within the fitting portion 321, and a retaining hole 324 for retaining engagement with the lance 312 on the housing 310 is formed through a peripheral wall of the fitting portion 321. The metal terminal 320 is passed through the seal holder 340 and the seal member 330, attached to the housing 310, from the rear side of the housing 310, and is inserted into the cavity 311 in the housing 310. Immediately before the metal terminal 320 reaches its proper inserted position, the lance 312 interferes with the outer surface of the peripheral wall of the fitting portion 321, and therefore is elastically deformed outwardly from the housing 310, and then when the metal terminal 320 reaches its proper inserted position, the lance 312 is elastically restored into its original shape to be retainingly engaged in the retaining hole 324, thereby retaining the metal terminal 320 against withdrawal.

(Seal Member 330)

The seal member 330 is made of rubber, and comprises a thick plate of an elongate oval shape, and is held between the rear end surface of the housing 310 and the front end surface of the seal holder 340. A plurality of seal holes 331 are formed through the seal member 330, and are open to the front and rear sides of the seal member 330, and are aligned respectively with the cavities 311 in the housing 310. Each of the seal holes 331 has a circular shape, and three lips 331A of a generally triangular cross-section are formed circumferentially on an inner peripheral surface of the seal hole 331. The inner diameter of each lip 331A is smaller than the outer diameter of the wire 325. The wire 325 is passed through the seal hole 331, and the lips 331A are elastically held in intimate contact with the outer peripheral surface of the wire 325, thereby forming a seal between the wire 325 and the inner surface of the seal hole 331. Three lips 334 of a generally semi-circular cross-section are formed on the outer peripheral surface of the seal member 330, and extend in a direction of the periphery thereof. The lips 334 are elastically held against the inner peripheral surface of the cap 360 to form a seal between the outer peripheral surface of the seal member 30 and the inner peripheral surface of the cap 360, thereby keeping the interior of the cap 360 in a waterproof, dust-proof condition.

(Seal Holder 340)

The seal holder 340 is made of a synthetic resin, and comprises a thick plate of an elongate oval shape like the seal member 330. The lips 334 on the outer peripheral surface of the seal member 330 are a size larger than the outer periphery of the seal holder 340. Terminal insertion holes 341 are formed through the seal holder 340, and extend from the front side thereof to the rear side thereof, and are aligned with the cavities 311, respectively, and also with the seal holes 331, respectively. The metal terminal 320 is inserted through the terminal insertion hole 341 into the cavity 311. Projections (not shown), projecting from the housing 310, extend watertight through the seal member 330, and are retainingly engaged at their distal ends with the seal holder 340, thereby holding the seal member 330 and the seal holder 340 on the housing 310.

Four lock projections 344 are formed on the outer peripheral surface of the seal holder 340, and more specifically two lock projections 344 are formed respectively on opposite end portions of each of upper and lower flat surfaces of the seal holder 340. These lock projections 344 are engaged with the cap 360, thereby preventing the cap 360 from being disengaged from the housing 310, the seal member 330 and the seal holder 340. A pair of index projections 345 are formed on the outer peripheral surface of the seal holder 340, and are symmetrically disposed respectively at arcuate portions of right and left end portions of the seal holder 340, the index projections 345 projecting upwardly beyond the upper surface of the seal holder 340. These index projections 345 serve as index means by which the upper and lower sides of the housing 310 are determined when inserting the metal terminals 320.

(Bus Bar Structure 350)

The bus bar structure 350 is formed by integrally joining a bus bar 355 of metal to a holder body 351 of a synthetic resin by insert molding. A method of producing the bus bar structure 350 will be more fully described hereafter. The holder body 351 includes a plate-like holder portion 352 (which is elongate in a direction of the width of the holder body 351), and a flattened, tubular portion 353 extending rearwardly (toward the housing 310) from the plate-like holder portion 352. The bus bar 355 includes a plurality of juxtaposed tabs 357 extending from a side edge of a strip-like interconnecting portion 356 in a cantilever manner. The bus bar 355 is held in the holder body 351 in such a manner that the interconnecting portion 356 extends along the plate-like holder portion 352 in contiguous relation thereto, with the tabs 357 projecting into the interior of the tubular portion 353. A plurality of punching holes 354 are formed in one side (surface) of the plate-like holder portion 352, and the punching hole 354 is provided at that portion of the interconnecting portion 356 disposed between the adjacent tabs 357. The interconnecting portion 356 is severed at any one of the punching holes 354, thereby dividing the bus bar 355 into a predetermined short-circuiting pattern.

The bus bar structures 350 are attached to the housing 310 from the front side thereof in such a manner that the upper row of cavities 311 and the lower row of cavities 311 are covered with the tubular portions 353 of these bus bar structures 350, respectively. In this attached condition, the tabs 357 are connected to the metal terminals 320, respectively.

Guide grooves 358 are formed respectively in opposite (right and left) sides of the tubular portion 353, and extend in the forward-rearward direction, and two pairs of front and rear retaining projections 317 and 318, corresponding respectively to the guide grooves 358, are formed on each of the upper and lower portions of the housing 310. When a rear edge of each guide groove 358 and the rear end of the tubular portion 353 are retainingly engaged with opposed surfaces of the associated retaining projections 317 and 318, respectively, the bus bar structure 350 is held in a provisionally-retained position. When the front and rear edges of each guide groove 358 are retainingly engaged with the rear surface of the retaining projection 317 and the front surface of the retaining projection 318, the bus bar structure 350 is held in a properly-attached position.

(Cap 360)

The cap 360 is made of a synthetic resin, and has a tubular shape of an elongate oval cross-section (as seen from the front side thereof) with a closed bottom. Lock holes 361 are formed in a peripheral edge portion of the open end of the cap 360, and the lock projections 344 on the seal holder 340 can be retainingly engaged in these lock holes 361, respectively. When the lock projections 344 are engaged in the lock holes 361, respectively, the cap 360 is locked in its attached condition. Outwardly-bulging relief portions 362 for avoiding the interference of the cap 360 with the index projections are formed on the peripheral edge portion of the open end of the cap 360. That portion of an inner peripheral surface of the cap 360, disposed adjacent to the open end thereof, serves as a seal surface against which the lips 334 on the outer peripheral surface of the seal member 330 can be elastically held.

(Assembling of the Parts)

The procedure of assembling the above parts are as follows. First, the seal member 330 and the seal holder 340 are attached to the housing 310, and the metal terminals 320 are inserted into the respective terminal insertion holes 341, and are passed through the respective seal holes 331, and are inserted into the respective cavities 311. Then, each bus bar structures 350 is attached to the housing 310, and is held in the provisionally-retained position. At this time, the distal end surface (remote from the tubular portion 353) of the holder body 351 of the bus bar structure 350 is pushed by the finger. Then, the housing, having the bus bar structures 350 mounted thereon in their respective retained positions, is set in an assembling apparatus (not shown), and the bus bar structure 350 is forced from the provisionally-retained position into the properly-attached position. As a result, the tabs 357 are connected to the associated metal terminals 320, respectively, so that these metal terminals 320 are short-circuited in the predetermined pattern.

(Method of producing the Bus Bar Structure 350 and Operation and Effects of this Embodiment)

The process of producing the bus bar structure 350 comprises the steps of (1) forming a chain terminal structure 370, (2) integrally joining bus bars 355 of the chain terminal structure 370 respectively to holder bodies 351, by insert molding, (3) cutting off each bus bar 355 and holder body 351, thus integrally joined together, to provide the bus bar structure 350, and (4) dividing (or severing) the bus bar 355 of each bus bar structure 350 into a predetermined short-circuiting pattern if necessary.

Figure 20:
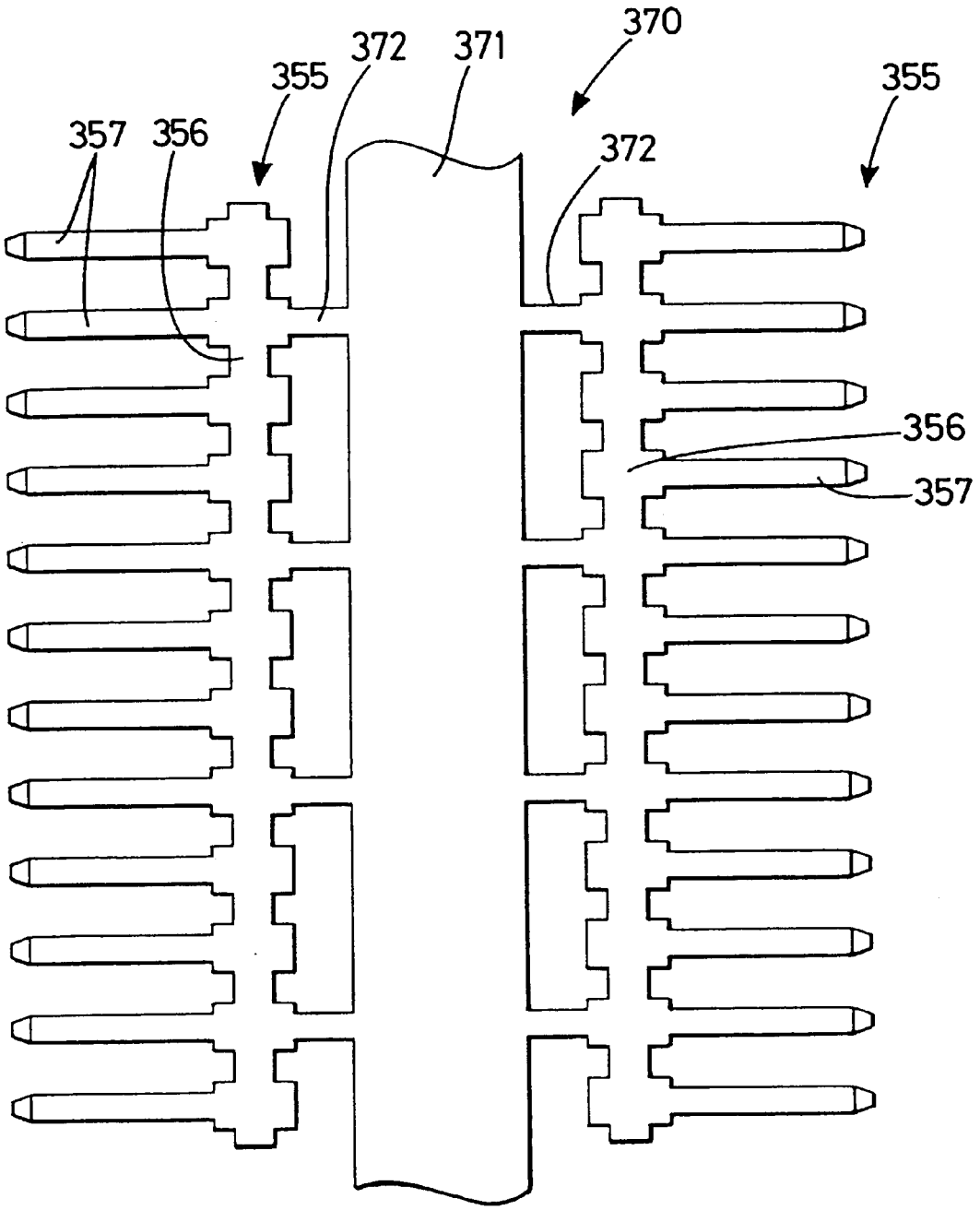
FIG. 20 is a plan view of the chain terminal structure.
Figure 21:
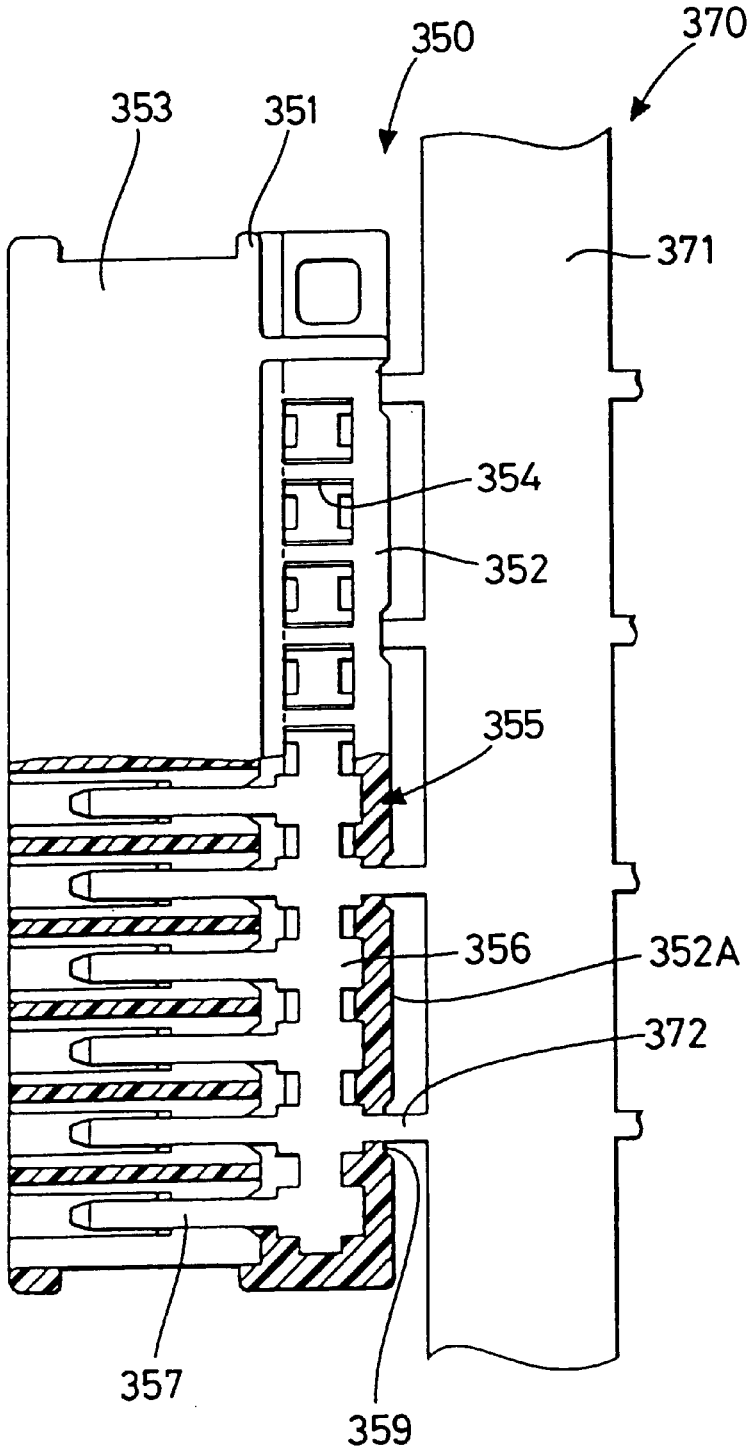
FIG. 21 is a partly-broken, plan view showing a condition in which a bus bar is integrally joined to a holder body by insert molding.

(1) The chain terminal structure 370 is blanked or stamped from an electrically-conductive metal strip of a predetermined width by the use of a press. As shown in FIG. 20, this chain terminal structure of a predetermined shape has many bus bars 355 connected to opposite side edges of a long carrier 371. Each bus bar 355 is connected to the carrier 371 by four bridge portions 372. The narrow, elongate bridge portions 372 extend perpendicularly to the direction of the length of the carrier 371, and the four bridge portions 372 are connected to that side edge of the interconnecting portion 356 of the bus bar 355 facing away from the projected tabs 357. Namely, the interconnecting portion 356 is parallel to the carrier 371, and the tabs 357 are perpendicular to the carrier 371.

(2) The bus bars 355, connected to the carrier 371, are insert molded independently of each other, using an automatic machine (not shown). In the insert molded condition, the bridge portions 372 pass through the holder body 351 of the bus bar structure 350, and further extend from the distal end surface 352A of the plate-like holder portion 352 (remote from the tubular portion 353) to the carrier 371. Recesses 359 of a trapezoidal shape are formed respectively in those portions of the distal end surface 352A of the holder body 351 from which the bridge portions 372 project, respectively. These recesses 359 are much smaller in size than the tip of the finger of the operator. This is determined in view of the fact that the distal end surface 352A of the holder body 351 is pushed by the finger when attaching the bus bar structure 350 to the housing 310. With this arrangement, the finger will not be inserted deep into the recess 359.

Figure 19:
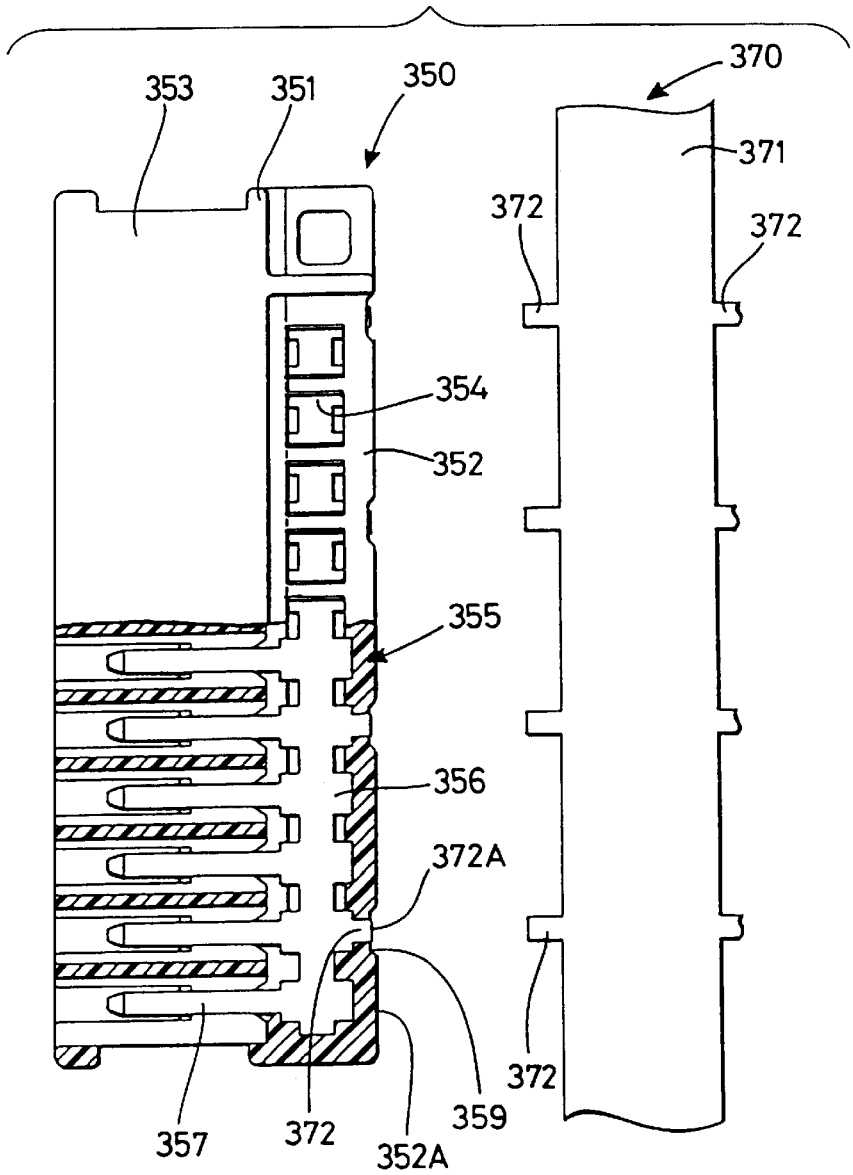
FIG. 19 is a partly-broken, plan view showing a condition in which the bus bar structure is cut off from a carrier of a chain terminal structure.

(3) After the insert molding, the bus bar 355 and holder body 351, integrally joined together, are cut off from the carrier 371 by severing the bridge portions 372, as shown in FIG. 19. At this time, each bridge portion 372 is severed or cut at a portion thereof disposed immediately adjacent to the bottom surface of the recess 359, that is, disposed inwardly of the distal end surface 352A of the holder body 351. Therefore, although a cut surface 372A of the bridge 372, resulting from this cutting operation, is exposed to the distal end surface 352A of the holder body 351, the finger will not come into contact the cut surface 372A when the finger is pressed against the distal end surface 352A of the holder body 351. By thus severing the bridge portions 372, the bus bar structure 350, separated from the carrier 371, is obtained.

(4) If necessary, the interconnecting portion 356 of the bus bar structure 350, cut off from the carrier 371, is severed at the selected punching hole 354, thereby dividing the bus bar 355 into a plurality of sections to obtain the predetermined short-circuiting pattern. If this is not necessary, the severance of the bus bar 355 is not effected.

As described above, in the production of the bus bar structure 350, each bus bar 355 of the chain terminal structure 370 is connected to the carrier 371 not through the tabs 357 but through the bridge portions 372 connected to the side edge of the interconnecting portion 356. Therefore, when the bridge portions 372 are cut or severed, any cutting mark is not formed on the tabs 357. Therefore, the distal end of the tab 357, pressed into a tapering shape, is not deformed, and therefore any flash is not formed on the tab 357, and the metal terminal 320 is not caught by such flash when connecting the metal terminal to the tab.

(Other Embodiments)

The present invention is not limited to the above description and the drawings, and for example, the following embodiments fall within the scope of the invention. Further, various modifications other than the following can be made without departing from the scope of the invention.

(1) In the above embodiment, although the bridge portions of the chain terminal structure are connected to that side edge of the interconnecting portion facing away from the tabs, the bridge portions may be connected to that side edge of the interconnecting portion disposed perpendicularly to that side edge of the interconnecting portion from which the tabs project.

(2) In the above embodiment, although the tabs of the chain terminal structure extend in the direction perpendicular to the direction of the length of the carrier, the tabs may extend in the direction of the length of the carrier.

(3) In the above embodiment, although those portions of the outer surface of the holder body, to which the cut surfaces of the bridge portions are exposed, respectively, are recessed, a pair of projections may be formed respectively on opposite sides of each cut surface-exposed portion. With this construction, the finger will not come into contact with the cut surface.

What is claimed is:

1. A joint connector comprising:

a housing having a plurality of juxtaposed metal terminals received therein;

a bus bar base member having a plurality of juxtaposed tabs extending from a side edge of an interconnecting portion;

a holder body of a synthetic resin having a first side and a second side, only the first side having a plurality of punching holes, integrally joined to said bus bar base member;

a portion of said interconnecting portion, disposed between adjacent tabs, being exposed through a corresponding one of the punching holes and when said portion of said interconnecting portion is severed, forming a bus bar structure having a plurality of bus bars each having a plurality of tabs;

said tabs contact the associated metal terminals, respectively so that said metal terminals are short-circuited in a predetermined pattern; and an entire surface of said interconnecting portion facing away from said punching holes is exposed.

2. The joint connector according to claim 1, wherein a cap is attached to said housing to cover said bus bar structure.

3. The joint connector according to claim 2, wherein a seal member is provided on said housing, and is fitted watertight in an open end of said cap.

4. A joint connector as claimed in claim 1, further comprising:

a carrier having side edges connected to the interconnecting portion through bridge portions, connected to a side of the interconnecting portion facing away from the tabs;

said plurality of bus bars and said holder body, integrally joined together, are separated from said carrier by cutting surfaces of said bridge portions; and each of said plurality of bus bars are connected to said carrier through said bridge portions connected to said interconnecting portion of said plurality of said bus bars.

5. The joint connector according to claim 4, wherein said bus bar of said chain terminal structure is connected to said carrier through said bridge portions connected to that edge of said interconnecting portion facing away from said tabs, cut surfaces of said bridge portions of said bus bar structure are exposed to an outer surface of said holder body, said bus bar structure is attached to said housing by pushing said outer surface, to which said cut surfaces of said bridge portions are exposed, by the finger, recesses are formed respectively in those portions of said outer surface of said holder body to which said cut surfaces of said bridge portions are exposed, respectively, and each of said bridge portions is cut at a portion thereof disposed immediately adjacent to a bottom surface of the corresponding recess.

6. A joint connector as claimed in claim 1 wherein:

the bus bar base member is integrally joined to the holder body by insert molding, window holes are formed in said holder body, and opposite end portions of said interconnecting portion, disposed outside a severance-applying portion of said interconnecting portion, are exposed to the exterior through the respective window holes.

7. A method of producing a joint connector including a housing having a plurality of juxtaposed metal terminals received therein, said method comprising the steps of:

joining integrally by insert molding, a bus bar base member having a plurality of juxtaposed tabs extending from a side edge of an interconnecting portion, to a holder body formed of a synthetic resin and having a first side and a second side, only the first side having a plurality of punching holes, a portion of said interconnecting portion, disposed between adjacent tabs, being exposed through a corresponding one of the punching holes, an entire surface portion of said interconnecting portion facing away from said punching hole is exposed and during the insert molding, opposite end portions of said interconnecting portion, disposed outside a severance-applying region of said interconnecting portion are held;

severing said interconnecting portion at any one of said plurality of punching holes;

forming a bus bar structure by dividing said bus bar base member into a plurality of bus bars each having a plurality of tabs;

attaching said bus bar structure to said housing;

contacting said tabs to the associated metal terminals, respectively; and making said metal terminals short-circuited in a predetermined pattern.

8. A method of producing a joint connector including:

a housing having a plurality of juxtaposed metal terminals provided therein; and a bus bar structure, which includes an electrically-conductive bus bar, having a plurality of juxtaposed tabs extending from an edge of an interconnecting portion, and a holder body formed of a synthetic resin and having a first side and a second side, only the first side having a plurality of punching holes, the holder body integrally joined to said bus bar, an entire surface of said interconnecting portion facing away from said punching holes is exposed;

wherein when said bus bar structure is attached to said housing, said tabs contact the associated metal terminals, respectively, so that said metal terminals are short-circuited in a predetermined pattern;

said method comprising the steps of:

forming, by pressing, a chain terminal structure having a plurality of said bus bars connected to side edges of a carrier through bridge portions, said bridge portions being connected to a side of said interconnecting portion of said bus bar facing away from the tabs;

integrally joining said bus bar to said holder body by insert molding; and separating said bus bar and said holder body, thus integrally joined together, from said carrier by cutting said bridge portions, thereby obtaining said bus bar structure.

9. A joint connector comprising:

a housing having a plurality of juxtaposed metal terminals received therein;

a bus bar base member having a plurality of juxtaposed tabs extending from a side edge of an interconnecting portion;

a holder body of a synthetic resin and having a first side and a second side, only the first side having a plurality of punching holes, the holder body integrally joined to said bus bar base member;

a portion of said interconnecting portion, disposed between adjacent tabs, being exposed through a corresponding one of the punching holes, and when said portion of said interconnecting portion is severed, forming a bus bar structure having a plurality of bus bars each having a plurality of tabs;

said tabs contact the associated metal terminals, respectively so that said metal terminals are short-circuited in a predetermined pattern;

an entire surface of said interconnecting portion facing away from said punching holes is exposed; and a portion of said housing is removed to expose a surface of said interconnecting portion facing away from said punching holes over an entire area thereof, a die being in contact with said entire area.

* * * * *